US011846431B2

(12) United States Patent
Kim et al.

(10) Patent No.: US 11,846,431 B2
(45) **Date of Patent: *Dec. 19, 2023**

(54) COOKING APPARATUS

(71) Applicant: LG ELECTRONICS INC., Seoul (KR)

(72) Inventors: Hyohee Kim, Seoul (KR); Dongwoo Seo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 409 days.

This patent is subject to a terminal disclaimer.

(21) Appl. No.: 17/160,542

(22) Filed: Jan. 28, 2021

(65) Prior Publication Data

US 2021/0148574 A1 May 20, 2021

Related U.S. Application Data

(63) Continuation of application No. 16/148,024, filed on Oct. 1, 2018, now Pat. No. 10,935,247.

(60) Provisional application No. 62/565,132, filed on Sep. 29, 2017.

(51) Int. Cl.

| | |
|---|---|
| ***F24C 3/08*** | (2006.01) |
| ***F24C 3/12*** | (2006.01) |
| ***F24C 15/08*** | (2006.01) |
| ***F24C 15/10*** | (2006.01) |
| ***F24C 3/00*** | (2006.01) |
| ***F24C 3/06*** | (2021.01) |
| ***F24C 11/00*** | (2006.01) |
| ***F24C 15/00*** | (2006.01) |

(52) U.S. Cl.

CPC ..... *F24C 3/085* (2013.01); *F24C 3/008* (2013.01); *F24C 3/067* (2013.01); *F24C 3/124* (2013.01); *F24C 3/126* (2013.01); *F24C 11/00* (2013.01); *F24C 15/006* (2013.01); *F24C 15/08* (2013.01); *F24C 15/108* (2013.01)

(58) Field of Classification Search

CPC ..... F24C 1/06; A47J 37/108; Y10S 439/928

See application file for complete search history.

(56) References Cited

U.S. PATENT DOCUMENTS 1,693,784 A * 12/1928 Hollands ..... A47J 37/0611 99/374
2,457,877 A * 1/1949 Doner ..... F24C 7/082 219/415

(Continued)

FOREIGN PATENT DOCUMENTS

CN 101277558 A * 10/2008 ..... F24C 7/082
DE 19757004 A1 * 7/1999 ..... A47B 77/08

(Continued)

OTHER PUBLICATIONS

Korean Office Action dated Jun. 23, 2022 issued in Application No. 10-2021-0040174.

(Continued)

*Primary Examiner* — Jorge A Pereiro
(74) *Attorney, Agent, or Firm* — KED & ASSOCIATES

(57) ABSTRACT

Provided is a cooking apparatus. The cooking apparatus has a structure in which cooking modules different from each other are selectively mounted with a free arrangement structure on a top surface of the cooking apparatus.

18 Claims, 30 Drawing Sheets

(56) References Cited

U.S. PATENT DOCUMENTS 2,798,930 A * 7/1957 Frost ..... F24C 15/102 219/403
3,169,518 A * 2/1965 Scott ..... A47B 77/08 126/39 R
3,392,720 A * 7/1968 Sherman ..... F24C 15/30 126/211
3,446,201 A * 5/1969 More ..... A47B 77/08 126/39 R
3,797,375 A * 3/1974 Cerola ..... F24C 15/2042 99/422
3,956,612 A * 5/1976 Ballard ..... H05B 3/20 219/486
4,042,806 A * 8/1977 McCartney ..... F24C 15/2042 219/400
4,415,788 A * 11/1983 Field ..... H05B 6/1263 219/452.12
4,431,892 A * 2/1984 White ..... F24C 15/101 126/299 D
4,549,052 A * 10/1985 Simon ..... F24C 15/101 D7/367
4,562,827 A * 1/1986 Cerola ..... F24C 15/2042 126/300
4,608,917 A 9/1986 Faaborg
4,917,006 A * 4/1990 Bowen ..... F24C 15/105 D7/346
4,922,079 A * 5/1990 Bowen ..... A47J 27/04 219/415
5,062,408 A 11/1991 Smith et al.
5,190,026 A * 3/1993 Doty ..... F24C 15/2042 126/41 R
5,301,653 A * 4/1994 Gerdes ..... F24C 15/2042 D7/346
6,032,662 A * 3/2000 Taplan ..... F24C 3/085 126/39 R
6,271,504 B1 * 8/2001 Barritt ..... F24C 15/18 126/211
6,274,848 B1 * 8/2001 Von Mosshaim ..... F24C 15/30 219/536
7,135,661 B2 11/2006 Park
7,140,206 B2 * 11/2006 Braun ..... D06F 31/00 68/3 R
7,150,166 B2 * 12/2006 Braun ..... D06F 39/12 68/3 R
9,372,002 B2 * 6/2016 Harward ..... F24C 15/14
10,415,835 B2 * 9/2019 Billman ..... F24C 15/107
2002/0043529 A1 * 4/2002 Pickering ..... A47J 37/0629 126/211
2002/0096509 A1 * 7/2002 Von Mosshaim ... A47J 36/2483 219/452.11
2004/0245246 A1 * 12/2004 Bakanowski ..... H05B 6/763 219/741
2005/0051148 A1 * 3/2005 Sung ..... A47J 37/0709 99/447
2006/0027561 A1 * 2/2006 Lee ..... H05B 3/008 219/460.1
2006/0049725 A1 * 3/2006 Simon ..... A47B 77/08 312/111
2006/0174863 A1 * 8/2006 Menegon ..... F24C 15/18 126/37 R
2008/0060634 A1 * 3/2008 Blum ..... F24C 15/18 126/369
2008/0202493 A1 * 8/2008 Dettloff ..... F24C 3/12 126/39 B
2008/0216817 A1 9/2008 Yungbluth
2009/0283090 A1 * 11/2009 Garvin ..... F24C 3/085 126/39 H
2009/0296371 A1 * 12/2009 Desmet ..... F24C 7/082 362/85
2010/0154655 A1 6/2010 Mehta et al.
2010/0175682 A1 7/2010 Erikson et al.
2010/0219179 A1 * 9/2010 Lin ..... F24C 15/101 165/104.31
2011/0041831 A1 * 2/2011 Dettloff ..... F24C 3/12 126/39 B
2011/0241503 A1 * 10/2011 Simon ..... F24C 15/30 312/111
2013/0206128 A1 * 8/2013 Sovar ..... F24C 3/126 126/42
2013/0292371 A1 * 11/2013 Braden ..... F24C 15/34 126/41 R
2013/0323663 A1 * 12/2013 Harward ..... F24C 15/36 432/247
2013/0327314 A1 * 12/2013 Green ..... F24C 15/10 126/39 B
2014/0047943 A1 * 2/2014 Camli ..... G05G 1/10 74/553
2014/0191639 A1 * 7/2014 Freeman ..... F24C 15/08 312/352
2014/0261009 A1 9/2014 Bringe et al.
2014/0263276 A1 * 9/2014 Harward ..... F24C 1/06 219/454.12
2015/0075513 A1 * 3/2015 Paller ..... F24C 15/006 126/198
2015/0096550 A1 * 4/2015 Paller ..... F23D 14/10 126/21 R
2015/0096974 A1 * 4/2015 Freeman ..... F24C 15/106 29/407.01
2015/0292747 A1 * 10/2015 Daughtridge, Jr. ..... F24C 15/10 126/39 B
2015/0323194 A1 * 11/2015 Chadwick ..... F24C 15/006 219/400
2015/0323195 A1 * 11/2015 Chadwick ..... F24C 15/006 219/400
2015/0323196 A1 * 11/2015 Chadwick ..... F24C 15/006 219/400
2015/0335200 A1 11/2015 Ortner
2016/0169533 A1 6/2016 Deng et al.
2016/0296012 A1 * 10/2016 Ciccacci ..... A47B 77/08
2016/0296013 A1 * 10/2016 Ciccacci ..... F24C 15/08
2016/0298858 A1 * 10/2016 Ciccacci ..... A47B 91/005
2017/0023254 A1 * 1/2017 Cadima ..... A47J 37/049
2017/0227231 A1 * 8/2017 Pionek ..... F24C 3/124
2017/0332838 A1 11/2017 Dahle et al.
2018/0038596 A1 * 2/2018 Briscoe ..... F24C 15/006
2018/0206311 A1 * 7/2018 Yantis ..... F24C 7/082
2018/0209660 A1 * 7/2018 Stokes ..... F24C 15/14
2018/0353005 A1 * 12/2018 Lee ..... A47J 27/002
2019/0137109 A1 * 5/2019 Bruckbauer ..... F24C 3/124

FOREIGN PATENT DOCUMENTS

DE 200 14 949 12/2000
EP 1 719 953 8/2004
EP 1719953 A1 * 11/2006 ..... F24C 15/10
KR 10-1899249 9/2018
WO WO 2004/070278 8/2004
WO WO 2015/075587 5/2015

OTHER PUBLICATIONS

U.S. Office Action issued in U.S. Appl. No. 16/159,807 dated Jun. 4, 2021.
European Search Report dated Jul. 9, 2019.
Korean Office Action dated Sep. 30, 2019.
Korean Office Action dated Mar. 5, 2020.
U.S. Office Action dated Jun. 2, 2020 issued in U.S. Appl. No. 16/148,024.
Korean Office Action dated Dec. 29, 2020.

* cited by examiner

COOKING APPARATUS

CROSS-REFERENCE TO RELATED APPLICATIONS

This application is a Continuation of prior U.S. patent application Ser. No. 16/148,024, filed on Oct. 1, 2018, which claims the benefit of U.S. Provisional Application No. 62/565,132, filed on Sep. 29, 2017, whose entire disclosures are hereby incorporated by reference in their entirety.

BACKGROUND

The present disclosure relates to a cooking apparatus, and more particularly, to a cooking apparatus in which a configuration of a cooktop part is modularized to be combined in a shape desired by a user.

In general, a cooking apparatus is a home appliance for cooking food, which is installed in a kitchen space to cook the food according to user's intension. Such a cooking apparatus may be classified into various types according to a heat source or type to be used and a kind of fuel.

When the cooking apparatus is classified according to types of food to be cooked, the cooking apparatus may be classified into an open type cooking apparatus and a close type cooking apparatus according to types of spaces in which food is placed. The close type cooking apparatus includes an oven, a microwave oven, and the like, and the open type cooking apparatus includes a cooktop, a hob, and the like.

In recent years, a complex type cooking apparatus in which an open type cooking apparatus is disposed above a close type cooking apparatus has been developed and also has been developed to be combined with apparatuses having various cooking manners and structures.

SUMMARY

Embodiments provide a cooking apparatus in which cooking modules having different types of cooking manners or heat sources are modularized to be mounted.

Embodiments also provide a cooking apparatus in which modularized cooking modules are mounted in various combinations.

Embodiments also provide a cooking apparatus in which a plurality of cooking modules are freely mounted on a top surface.

Embodiments also provide a cooking apparatus in which a plurality of modularized cooking modules have a common mounting structure.

Embodiments also provide a cooking apparatus in which cooking modules different from each other are disposed at the same height in a single case.

Embodiments also provide a cooking apparatus having a structure in which cooking modules different from each other are mounted by exchanging mounting positions.

Embodiments also provide a cooking apparatus in which cooking modules different from each other, which are disposed in a single case, are effectively insulated from each other.

Embodiments also provide a cooking apparatus having a structure of a manipulation part in which cooking modules different from each other are freely disposed.

In one embodiment, a cooking apparatus includes: an oven part on which a door opening and closing a cavity defining a cooking space is provided on a front surface thereof; a cooktop part provided above the oven part to define a top surface of the cooking apparatus; and an exhaust part provided at a rear side of the cooktop part to discharge heat of the oven part and the cooktop part, wherein the cooktop part includes: a module mounting space provided in the cooktop part and having an opened top surface; a plurality of cooking modules mounted through the opened top surface of the module mounting space and individually provided to independently cook food; a front support provided along a front end of the module mounting space to support all front ends of the plurality of cooking modules; and a rear support provided along a rear end of the module mounting space to support all rear ends of the plurality of cooking modules, wherein the plurality of cooking modules have the same unit length or lengths that corresponds to a multiple of the unit length in a horizontal direction to respectively cover unit areas of the module mounting space, and when the plurality of cooking modules are mounted, the entire opened top surface of the module mounting space is covered to define a top surface of the cooktop part.

The cooktop part may include: a base plate defining a bottom surface of the module mounting space; and a side plate provided on each of both sides of the base plate to define each of both side surfaces of the module mounting space.

A manipulation part for manipulating operations of the cooktop part and the oven part may be provided on a front surface of the cooktop part, both ends of the front support may be connected to the side plate to define an opened front surface of the module mounting space, and the opened front surface of the module mounting space may be covered by the manipulation part.

The manipulation part may include: a manipulation panel defining an outer appearance of the cooktop part; and a manipulation member mounted on the manipulation panel and disposed at a front side of the unit area of each of the cooking modules to manipulate an operation of the corresponding cooking module.

A knob unit or a valve unit connected to the manipulation member through the opened front surface of the opened front surface of the module mounting space may be disposed on the base plate, a knob unit coupling hole or a valve unit coupling hole in which the knob unit or the valve unit is mounted may be defined in the base plate, and the knob unit coupling hole or the valve unit coupling hole may be defined in each of all the unit areas.

The base plate may include: a bottom surface defining a bottom surface of the module mounting space; and a rear surface bent from a rear surface of the bottom surface to define a rear surface of the module mounting space, wherein the rear support may be disposed on an upper end of the rear surface.

The rear support may be provided by bending an upper end of the rear surface.

An opening communicating with the exhaust part to exhaust air for cooling the inside of the cooktop part may be defined in each of the unit area of the base plate.

The opening may be defined in a rear surface of the base plate.

An opening through which a gas tube connected to the cooking modules is accessible may be defined in each of the unit areas of the base plate.

An inclined surface that is inclined and connects a rear end of the bottom surface to a lower end of the rear surface may be further provided, and the opening may be defined in the inclined surface.

An opening which communicates with an inner space of the exhaust part and through which air within the cooking modules is exhausted through the exhaust part may be defined in a rear surface of the base plate facing the rear surface of each of the cooking modules.

The opening may be defined in each of all the unit areas.

The cooking apparatus may further include a module bracket provided inside the module mounting space to additionally support the cooking modules.

A front bracket mounting part and a rear bracket mounting part to which a front end and a rear end of the module bracket are detachably coupled may be provided on the front support and the rear support, respectively, and the front bracket mounting part and the rear bracket mounting part may be disposed in each unit area.

A deco member covering a space between the cooking modules may be provided between the cooking modules adjacent to each other, a front deco mounting part and a rear deco mounting part to which a front end and a rear end of the deco member are detachably coupled may be provided on the front support and the rear support, respectively, and the front deco mounting part and the rear deco mounting part may be disposed in each unit area.

The deco member may include: a cover part contacting outer ends facing each other of the adjacent cooking modules to further support the cooking modules; and a partition part extending downward from a bottom surface of the cover part and mounted on the front deco mounting part and the rear deco mounting part to partition the unit areas.

The cooking modules may include a plurality of combinations of: a burner module including at least one or more burners; an induction module heating a container in an induction heating manner using a working coil; a sous vide module heating the container within a housing that is sealed by a sous vide door through a heating part; and a griddle module heating a griddle plate, which is exposed upward, by a griddle burner provided in a griddle case.

The module bracket may include: a burner bracket which supports a lower portion of each of the plurality of burners and of which both ends are coupled to the front support and the rear support; a pair of induction bracket supporting both side ends of the induction module; a sous vide bracket mounted on a bottom of the module mounting space to support a lower portion of the housing; and a griddle bracket mounted on the bottom of the module mounting space to support a lower portion of the griddle case.

An insulation plate partitioning the unit areas to prevent heat from being transferred to the adjacent areas may be provided in the module mounting space.

The details of one or more embodiments are set forth in the accompanying drawings and the description below. Other features will be apparent from the description and drawings, and from the claims.

DETAILED DESCRIPTION OF THE EMBODIMENTS

Hereinafter, specific embodiments of the present invention will be described in detail with reference to the drawings. However, there is no intention to limit the present invention to the embodiments in which spirit of the present invention is provided and other embodiments which is included in the range of spirit of the other degenerative inventions or the present invention can be easily proposed by adding, changing, deleting or the like of another component.

Figure 1:
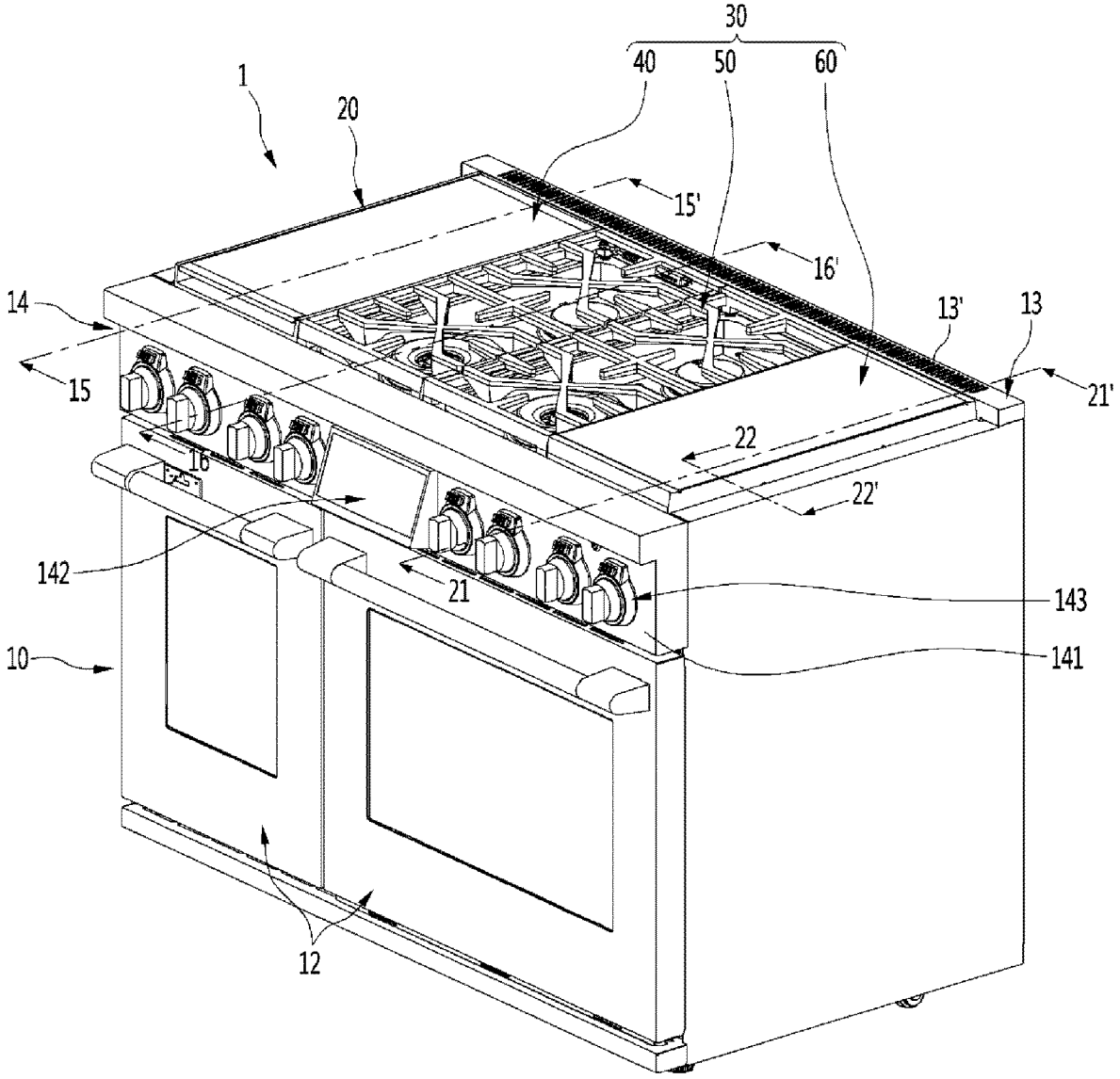
FIG. 1 is a perspective view of a cooking apparatus according to an embodiment.
Figure 2:
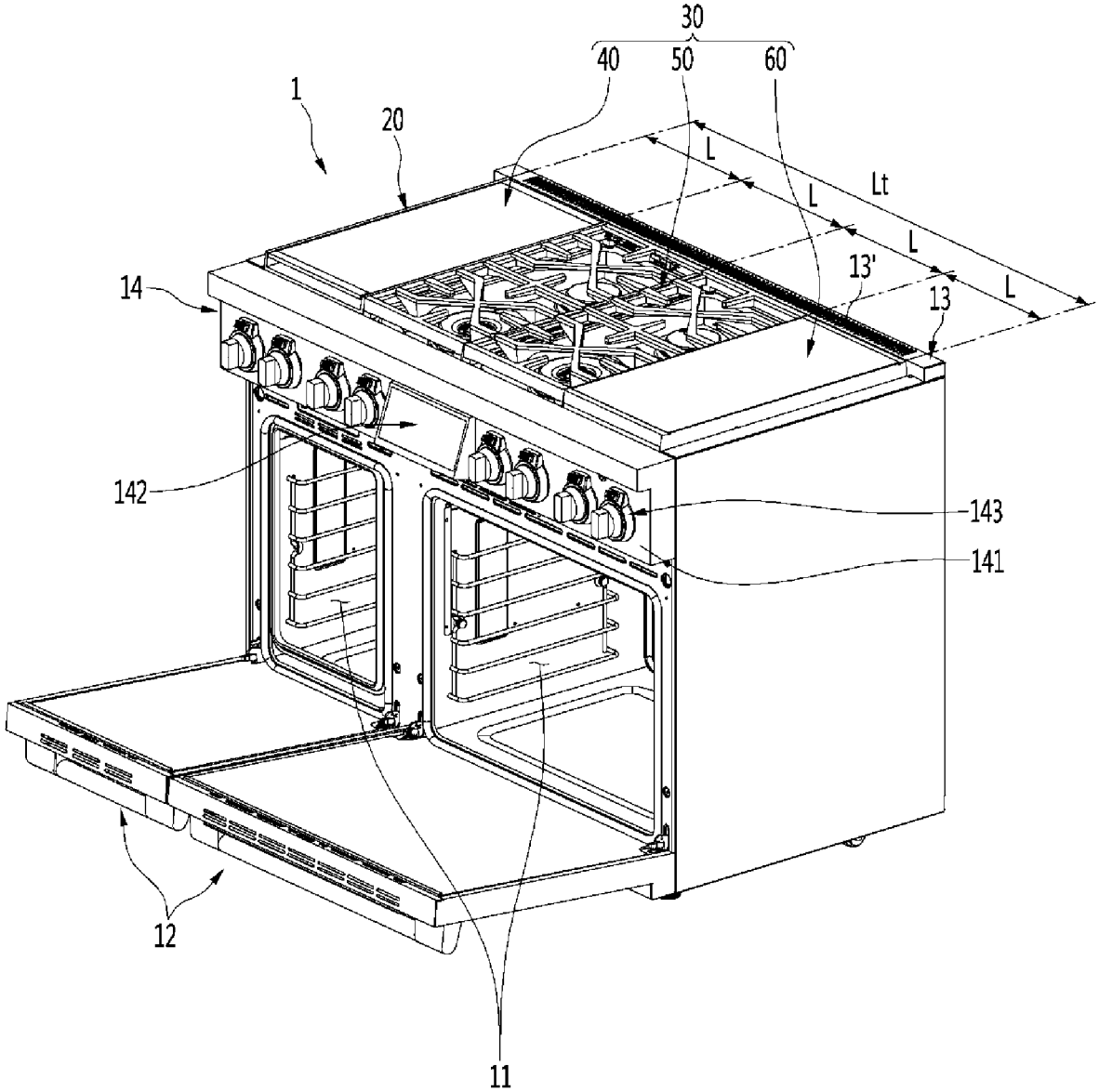
FIG. 2 is a perspective view illustrating a state in which a door of the cooking apparatus is opened.

FIG. 1 is a perspective view of a cooking apparatus according to an embodiment. Also, FIG. 2 is a perspective view illustrating a state in which a door of the cooking apparatus is opened.

As illustrated in the drawings, a cooking apparatus 1 according to an embodiment may be a complex type cooking apparatus. An oven part 10 may be provided in a lower portion, and a cooktop part 20 may be disposed in an upper portion.

A cavity 11 that is a cooking space may be provided in the oven part 10 and be opened by a door 12 that is openable at a front side thereof. The oven part 10 may be provided on each of both left and right sides. Thus, a pair of cavities 11 may be provided in both left and right sides, and the cavities 11 may be relatively opened and closed by the doors 12.

For example, as illustrated in the drawings, five oven parts 10 may be arranged on both left and right sides in parallel to each other. The five oven parts 10 may be vertically disposed or be provided as a single configuration.

When the oven part 10 is provided in plurality, the oven part 10 disposed at one side may be a gas oven using a gas burner as a heat source, and the oven part 10 disposed at the other side may be an electric oven using an electric heater as a heat source. Also, as necessary, the plurality of oven parts 10 may have the same heat source, but have different structures. Also, the oven part 10 may be provided on one portion of both left and right sides, and a simple accommodation space may be provided in the other side. Alternatively, the oven part 10 may have the same structure as the other cooking apparatus that is openable by the door, for example, a microwave oven.

A cooktop part 20 may be disposed above the oven part 10. The cooktop part 20 may be disposed on a top surface of the cooking apparatus 1. Also, various cooking devices that are capable of cooking food through the top surface of the cooking apparatus 1 may be mounted on the cooktop part 20 in a module type. Thus, the various cooking devices that are capable of being mounted on the cooktop part 20 may be called cooking modules.

In detail, the plurality of cooking modules 30 may be combined to be mounted on the cooktop part 20 as a whole. The cooking module 30 assembled to constitute the cooktop part 20 may include a gas stove (hereinafter, referred to as a burner module 50) constituted by at least one or more gas burners 501, 502, 503, and 504, an induction stove (hereinafter, referred to as an induction module 60) that is capable of heating a container in an induction heating manner, a sous vide cooking device (hereinafter, referred to as a sous vide module 40) that is capable of low-temperature sealed cooking such as sous vide cooking, a griddle cooking device (hereinafter, referred to as a griddle module 80) that is capable of cooking food on a heated iron plate.

The burner module 50, the induction module 60, the sous vide module 40, and the griddle module 80 may be called a first cooking module, a second cooking module, a third cooking module, and a fourth cooking module for convenience of description, respectively. Also, each of the cooking modules 30 may be called a cooking device and defined in various terms having a meaning that is capable of additionally mounted on the cooking apparatus 1.

The cooking modules 30 may be mounted on the cooktop part, and a portion of the plurality of cooking modules 30 may be selectively mounted in a state in which the oven part is assembled. That is, the cooking modules 30 may be continuously arranged in parallel to each other on the cooktop part 20, and a top surface of the cooktop part 20 may be defined by the plurality of cooking modules 30.

The cooking modules 30 may be mounted at any position on the cooktop part 20 and be selectively mounted according to required combination. Also, when the cooking modules 30 are freely combined and disposed to be mounted, the cooking modules 30 may be mounted at the same height to provide a sense of unit. In addition, a separate finishing material may be provided between the cooking modules 30 to improve the sense of unit.

As illustrated in the drawings, the burner module 50 may be mounted on a center of the cooktop part 20, and the sous vide module 40 and the induction module 60 may be respectively mounted on both left and right sides of the cooktop part 20. The cooking module 30 including the burner module 50, the sous vide module 40, and the induction module 60 may have the same length as the cooktop part 20 in a front and rear direction. Thus, when the cooking module 30 is mounted on the cooktop part 20, front and rear ends of the cooking module 30 may be respectively seated on front and rear ends of the cooktop part 20.

Also, a length of the cooking module 30 in a horizontal direction (a left and right direction in FIG. 1) may correspond to a 1/N of an total horizontal length Lt of the cooktop part 20 or an inner space of the cooktop part 20 and also correspond to a unit length L.

For example, the length of the cooktop part 20 in the horizontal direction may be set to four unit lengths L, and a horizontal length of each of the sous vide module 40 and the induction module 60 may correspond to one unit length L. Also, a horizontal length of the burner module 50 may correspond to two unit lengths L. Thus, the sous vide module 40, the burner module 50, and the induction module 60 may be disposed in the cooktop part 20 to define an entire top surface of the cooktop part 20.

Also, the burner module 50 may have a symmetrical structure in a left and right direction. As necessary, the burner module 50 may have a module shape having one unit length L. Here, the other cooking modules in addition to the burner module 50 may be continuously disposed. Alternatively, the two burner modules 50, each of which has one unit length L, may be disposed in parallel to each other, or the two burner modules 50 having two unit lengths may be disposed.

In the state in which all the cooking modules 30 are mounted on the cooktop part 20, the cooking module 30 may have the same height. That is, top surfaces of the sous vide module 40, the burner module 50, and the induction module 60 may be disposed on the same plane in the state of being mounted on the cooktop part 20. In more detail, all of a sous vide door 450 of the sous vide module 40, a grating 520 of the burner module 50, and a top plate 63 of the induction module 60 may be disposed on the same plane to allow the cooking apparatus 1 to realize the sense of unit as a whole.

An exhaust part 13 may be provided on a rear end of the cooktop part 20. The exhaust part 13 may exhaust air within the oven part 10 and also discharge heat within the cooktop part 20 to the outside.

A grill 131 in which a plurality of holes are continuously defined may be disposed on a top surface of the exhaust part 13. Also, the inside of the exhaust part 13 may communicate with the oven part 10 and the cooktop part 20. Thus, when the oven part 10 operates, heat and a combustion gas of the oven part 10 may be exhausted. Also, heat and a combustion gas generated when the cooking module 30 operates may be exhausted. In addition, cooling air introduced into the cooktop part 20 from the outside of the cooking apparatus 1 to cool the inside of the cooktop part 20 may also be discharged through the exhaust part 13.

A manipulation part 14 is provided on a front surface of the cooktop part 20. The manipulation part 14 may include a manipulation panel 141 defining the front surface of the cooktop part 20, a display 142 disposed on a center of the manipulation panel 141 to display operation information of the cooking apparatus 1, and a manipulation member 143 provided in plurality on both sides of the manipulation panel 141 with respect to the display 142. The manipulation members 143 may be provided as, for example, knobs and disposed at positions corresponding to mounting positions of the cooking modules 30 constituting the cooktop part 20. Thus, when the cooking modules 30 are changed in arrangement, the manipulation member 143 may also move to be changed in position.

Also, even though the cooking modules 30 are arranged in any arrangement order in the cooktop part 20, the manipulation members 143 may be disposed on the corresponding front area. Thus, although various cooking modules 30 are provided, a user may intuitively manipulate the corresponding manipulation member 143.

Figure 3:
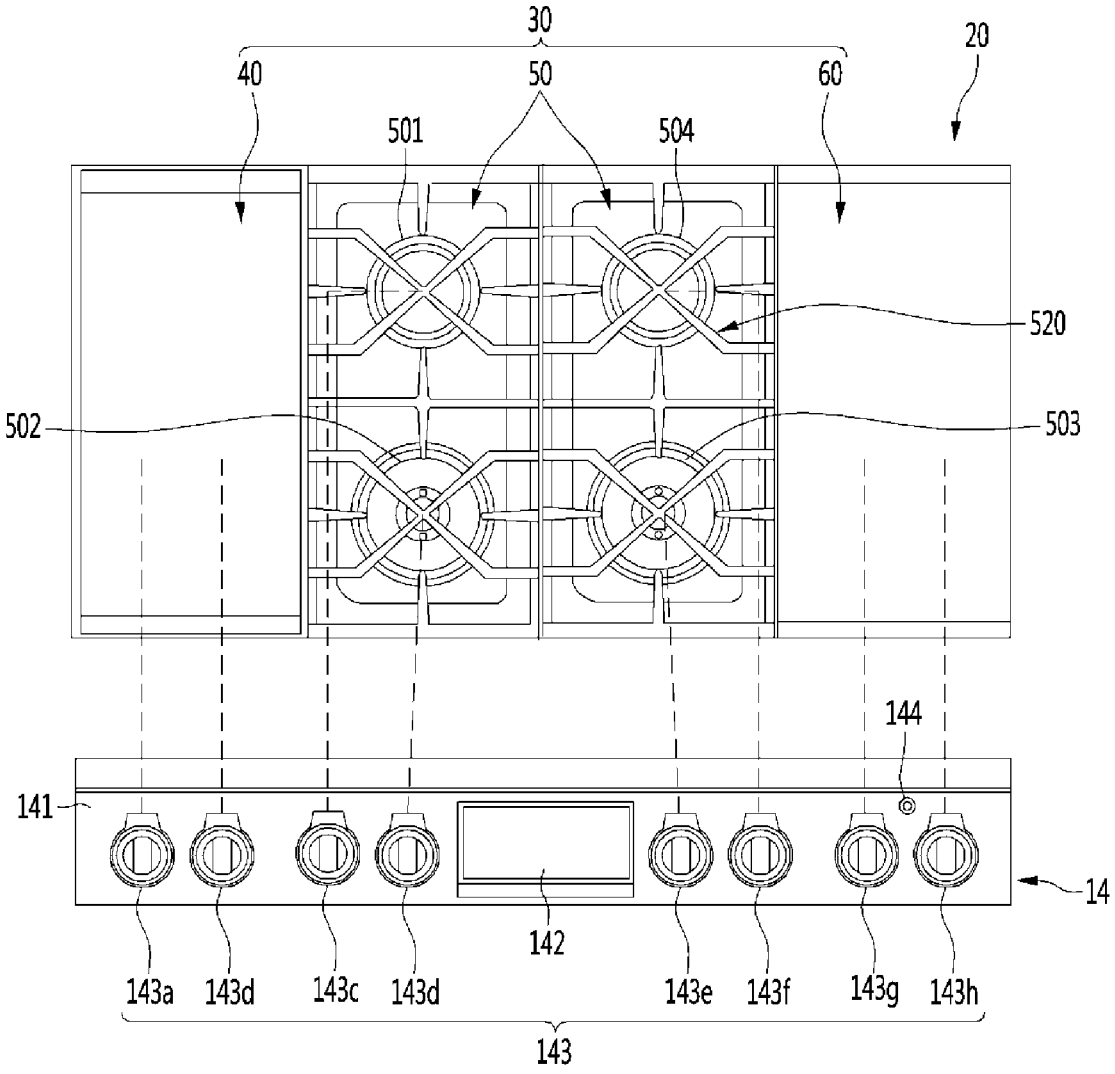
FIG. 3 is a view illustrating a relationship between a cooktop part and a manipulation part of the cooking apparatus.

FIG. 3 is a view illustrating a relationship between the cooktop part and the manipulation part of the cooking apparatus.

As illustrated in the drawing, the display 142 and the plurality of manipulation members 143 may be disposed on a front surface of the manipulation panel 141.

The display 142 may display an overall operation state of the cooking apparatus 1 and thus display various information on a screen. Also, the display 142 may be provided as the form of a touch screen to receive user's manipulation. Also, the display 142 may be configured to set and manipulate an operation of the oven part 10 through user's touch manipulation. Alternatively, the display 142 may be configured to set and manipulation operations of the cooking modules 30 in addition to the oven part 10. The display 142 may have a length that is less than at least one unit length L. Thus, the display 142 together with at least one manipulation member 143 may be provided within an area of the unit length L.

As illustrated in the drawing, the manipulation member 143 may include a first manipulation member 143*a* and a second manipulation member 143*b* at a front side of the sous vide module 40. Also, the first manipulation member 143*a* may be configured to set and manipulate a temperature of the sous vide module 40, and the second manipulation member 143*b* may be configured to set and manipulate an operation time of the sous vide module 40.

Third to sixth manipulation members 143*c* to 143*f* may be provided on a front side of the burner module 50. The third to sixth manipulation members 143*c* to 143*f* may be disposed on both left and right sides with respect to the display 142. The third manipulation member 143*c* and the fourth manipulation member 143*d* may be disposed on the front side of a first burner 501 and a second burner 502, and the fifth manipulation member 143*e* and the sixth manipulation member 143*f* may be may be disposed on the front side of a third burner 503 and a fourth burner 504.

The third manipulation member 143*c* may adjust thermal power of the first burner 501, and the fourth manipulation member 143*d* may be adjust thermal power of the second burner 502 that is disposed on the front side of the first burner 501. Also, the fifth manipulation member 143*e* may adjust thermal power of the third burner 503, and the sixth manipulation member 143*f* may be adjust thermal power of the fourth burner 504 that is disposed on the rear side of the third burner 503.

Seventh and eighth manipulation members 143*g* to 143*h* may be provided on a front side of the induction module 60. The seventh manipulation member 143*g* may manipulate a heating temperature of a rear area of the induction module 60, and the eighth manipulation member 143*h* may manipulate a heating temperature of a front area of the induction module 60. Also, an induction button 144 may be provided in a button type to adjust a heating area of the front area and the rear area according to a size of the container seated on the top plate 63 of the induction module 60 may be further provided between a seventh manipulation member 143*g* and the eighth manipulation member 143*h*.

Figure 4:
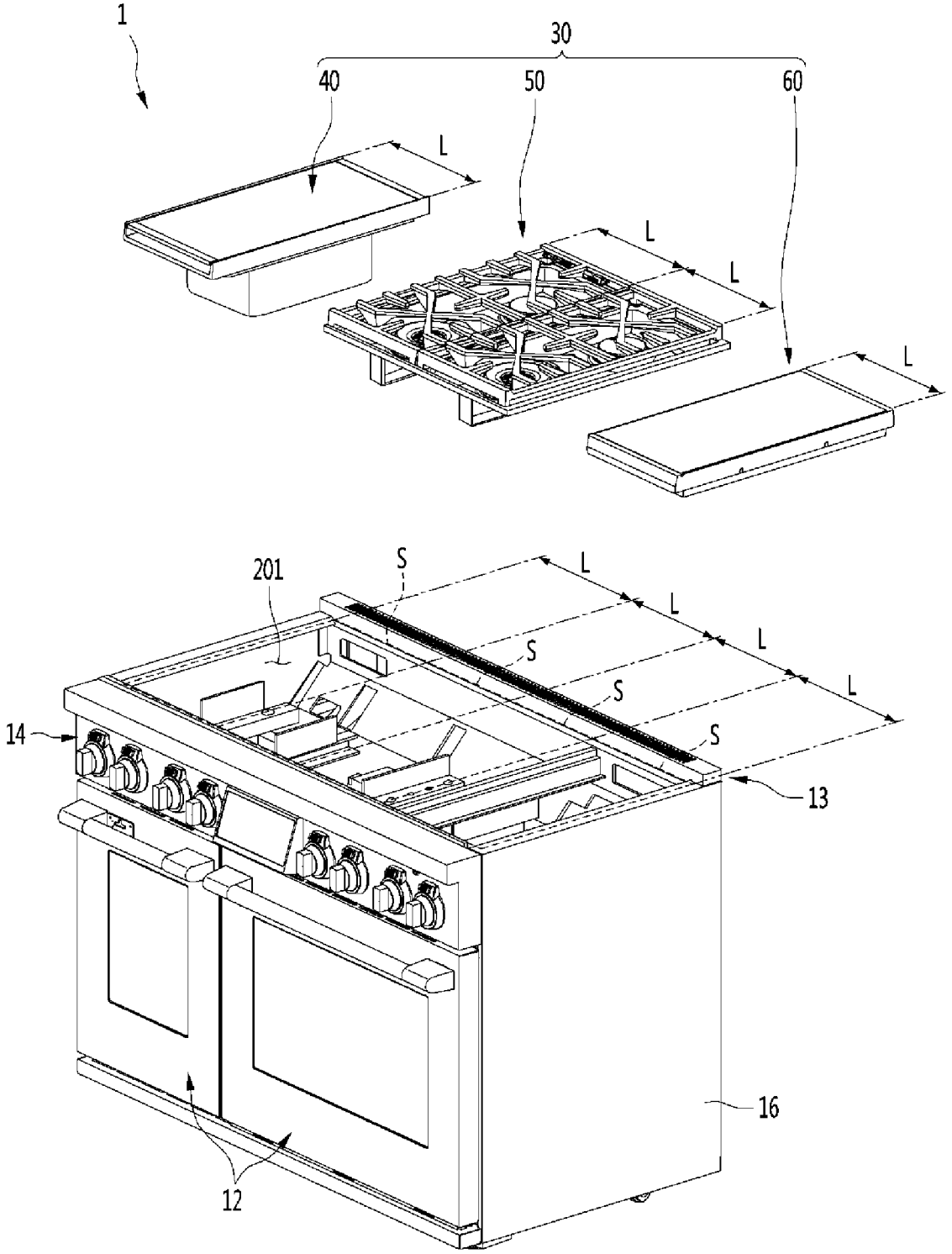
FIG. 4 is an exploded perspective view illustrating a state in which a cooking module mounted on the cooking apparatus is separated.
Figure 5:
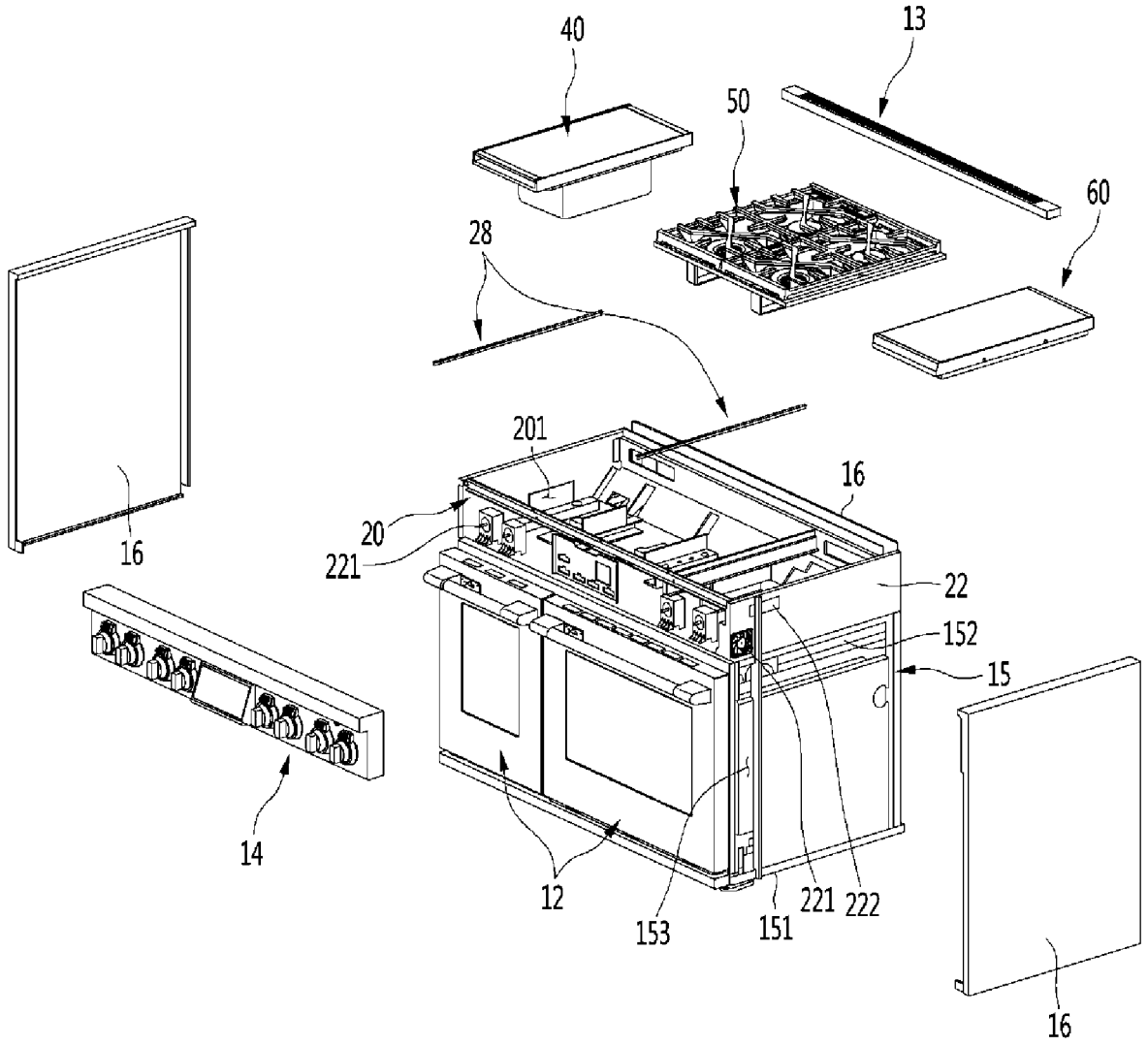
FIG. 5 is an exploded perspective view illustrating a state in which the cooktop part is further separated in the state of FIG. 4.
Figure 6:
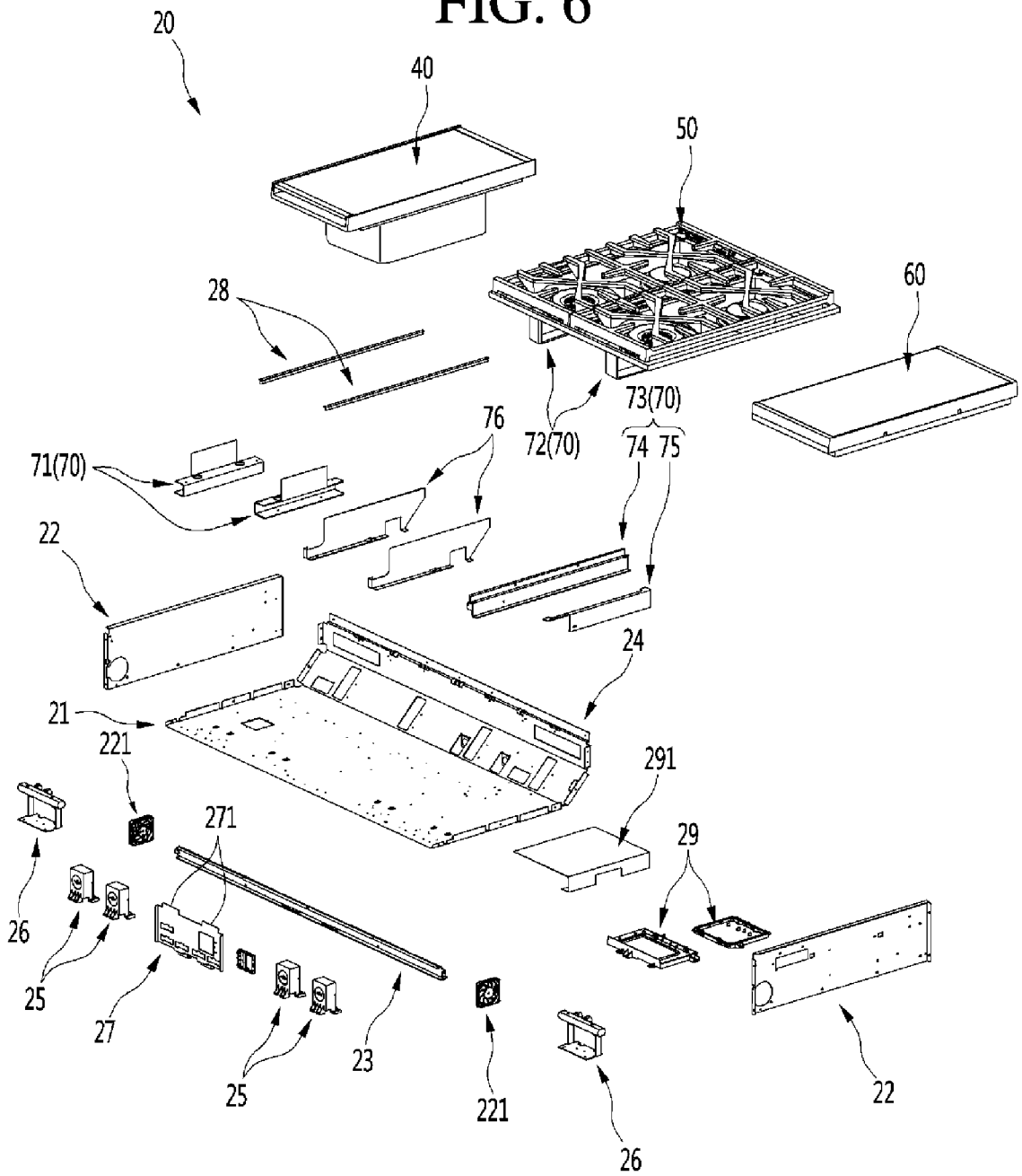
FIG. 6 is an exploded perspective of the cooktop part.

FIG. 4 is an exploded perspective view illustrating a state in which the cooking module mounted on the cooking apparatus is separated. Also, FIG. 5 is an exploded perspective view illustrating a state in which the cooktop part is further separated in the state of FIG. 4. Also, FIG. 6 is an exploded perspective of the cooktop part.

In the cooking apparatus 1, an entire mounting structure of the oven part 10 and the cooktop part 20 may be provided by a frame 15. Although not shown, the frame 15 may have a shape that is capable of supporting the oven part 10 and the cooktop part 20 and include an installation part 151 disposed on at least ground.

The installation part 151 may define a bottom surface of the cooking apparatus 1. The oven part 10 may be disposed on an upper portion of the installation part 151 disposed on the ground, and the cooktop part 20 may be sequentially disposed on the oven part 10. Also, an outer plate 16 may be provided on both left and right surfaces and a rear surface to define outer appearances of both side surfaces and a rear surface of the cooking apparatus 1. The outer plate 16 may extend up to the cooktop part 20 to cover the cooktop part 20 in addition to the outside of the oven part 10 at once.

The frame 15 may further include a cooktop support 152 for supporting the cooktop part 20. The cooktop support 152 may be disposed above at least the oven part 10 or extend up to an upper end of the oven part 10. Thus, the cooktop part 20 may be disposed to be spaced apart from the upper portion of the oven part 10.

Thus, a space may be defined between the oven part 10 and the cooktop part 20 to minimize introduction of heat, which is generated when the oven part 10, into the cooktop part 20 due to air introduced from the outside.

The cooktop part 20 may be disposed between the manipulation part 14 and the exhaust part 13. A front side of the cooktop part 20 may be covered by the manipulation part 14, and a rear side of the cooktop part 20 may be covered by the exhaust part 13. Also, both left and right sides of the cooktop part 20 may be covered by the outer plate 16.

Thus, the cooktop part 20 may include a module mounting space 201 that is opened upward. The cooking modules 30 may be mounted in parallel to each other in the module mounting space 201.

The cooktop part 20 may include a base plate 21 defining a bottom surface and a rear surface of the module mounting space 201, a side plate 22 coupled to both side ends of the base plate 21 to define side surfaces of the module mounting space 201, and a front support 23 connecting front ends of the side plate 22 to each other. The front support 23 may be disposed at a position that is spaced upward from a front end of the base plate 21 and also disposed at the front side at the same height as a rear support 24 that is disposed on a rear end of the base plate 21.

Also, the front side of the module mounting space 201 that is opened forward may be covered by the manipulation part 14. That is, the manipulation panel 141 defining an outer appearance of the manipulation part 14 may be coupled to a lower end of the base plate 21, a front end of the side plate 22, and the front support 23 to cover the opened front surface of the cooktop part 20.

Also, a plurality of knob units 25 and a valve unit 26 may be provided on the opened front end of the module mounting space 201. When the manipulation part 14 is mounted, the knob units 25 and the valve unit 26 may be coupled to the manipulation members 143 at corresponding positions. Thus, the knob units 25 and the valve unit 26 may be connected to the manipulation member 143 to allow the corresponding cooking modules 30 to be manipulated.

Since the cooking modules 30 are variously changed in arrangement and kind, the knob units 25 and the valve unit 26 may also be variously changed in arrangement and number. For this, the front surface of the module mounting space 201 may be opened to be directly connected to the manipulation part 14, and the knob units 25 and the valve unit 26 may be mounted on the base plate 21.

Also, a display PCB 27 may be disposed on the front end of the module mounting space 201. The display PCB 27 may be disposed at a position corresponding to the display 142. Also, an upper end of the display PCB 27 may be fixed and mounted on the front support 23. Here, the display PCB 27 may include a case on which a circuit board is mounted.

A plurality of module brackets 70 may be provided in the module mounting space 201. The module brackets 70 may have a different structure according to the cooking modules 30. The corresponding module bracket 70 may be mounted on a position at which the cooking module 30 is mounted.

In this embodiment, the module bracket 70 may include a sous vide bracket 71, a burner bracket 72, and an induction bracket 73, and their detailed structures will be described below.

Also, a deco member 28 partitioning the space in which the cooking modules are mounted and supporting side ends of the cooking modules 30 may be further provided in the module mounting space 201.

Both ends of the deco member 28 may be respectively fixed to the front support 23 and the rear support 24, and the deco member 28 may partition the module mounting space to define areas on which the cooking modules 30 are mounted.

Also, a side cooling fan 221 may be provided on each of both sides of the module mounting space 201. The side cooling fan 221 may be configured to suction external air so as to cool the inside of the cooktop part 20 and disposed on each of front ends of both side surfaces of the cooktop part 20.

Also, a suction passage 153 may be provided in each of both sides of the frame 15 corresponding to the cooling fan 221. The suction passage 153 may extend up to the lower end of the cooking apparatus 1 to suction external air through an opened lower side thereof. The suction passage 153 may be defined by a separate plate or frame structure constituting the frame 15 and be covered by the outer plate 16 to provide a passage through which cold air flows.

Figure 7:
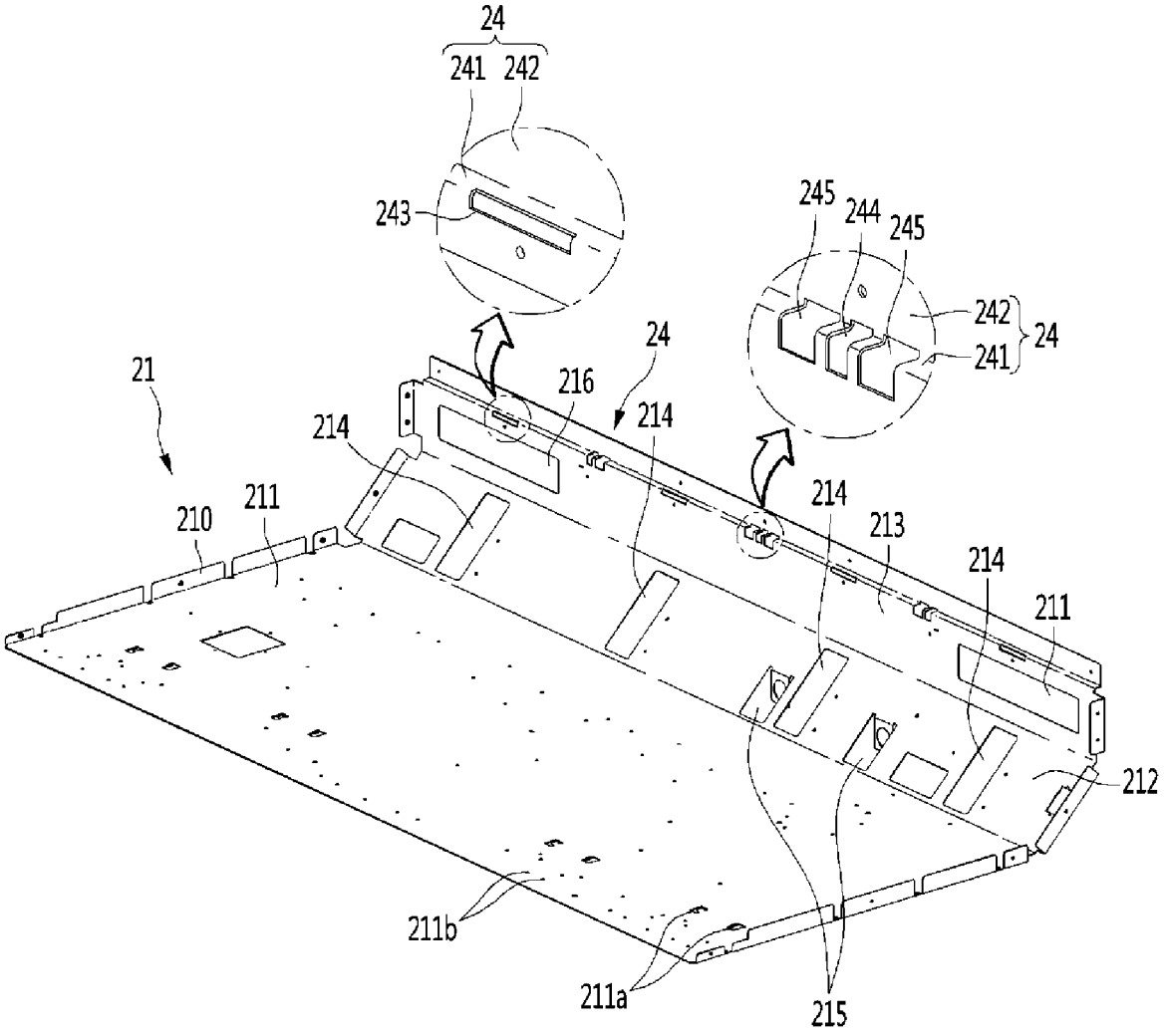
FIG. 7 is a perspective view of a base plate that is one component of the cooktop part.
Figure 8:
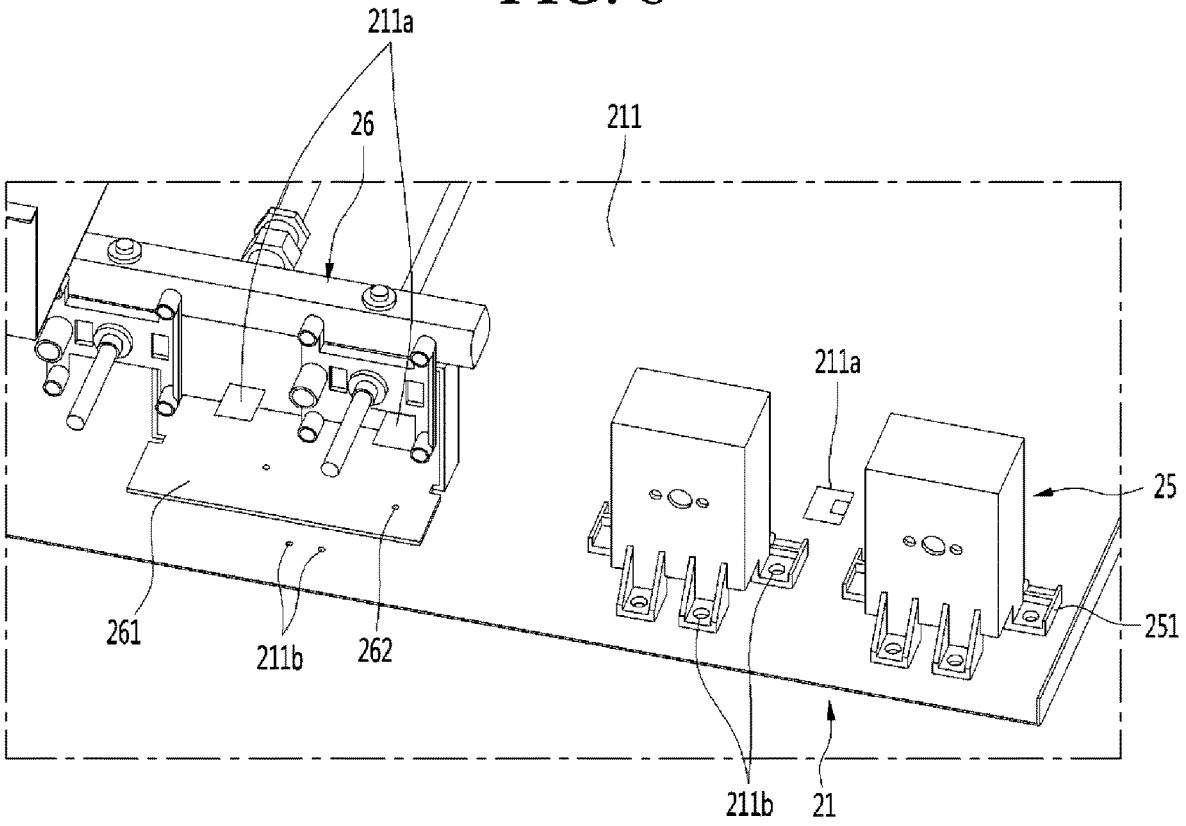
FIG. 8 is a partial perspective view illustrating a state in which a valve unit and a knob unit are mounted on the base plate.

FIG. 7 is a perspective view of the base plate that is one component of the cooktop part. Also, FIG. 8 is a partial perspective view illustrating a state in which the valve unit and the knob unit are mounted on the base plate.

As illustrated in the drawings, in the base plate 21, a plate-shaped material may be bent several times to define the bottom of the cooktop part 20. Also, the base plate 21 may define at least a portion of the rear surface of the cooktop part 20. The rear support 24 may be provided on a rear end of the base plate 21. The rear support 24 may be provided as a separate part with respect to the base plate 21, or a rear end of the base plate 21 may be bent to be integrated with the rear support 24.

The base plate 21 may include a bottom surface 211, an inclined surface 212, and a rear surface 213. Also, a base coupling part 210 to be coupled to the side plate 22 may be provided on each of both left and right ends of the base plate 21.

The bottom surface 211 may define the bottom surface of the cooktop part 20, i.e., the bottom surface 211 of the module mounting space 201. Also, the inclined surface 212 may extend upward from a rear end of the bottom surface 211. Here, as the inclined surface 212 extends upward, the inclined surface 212 may be inclined backward. Also, the rear surface 213 may extend upward from an upper end of the inclined surface 212 so as to be perpendicular to the bottom surface 211. The rear surface of the module mounting space 201 may be defined by the inclined surface 212 and the rear surface 213. Also, the rear surface 213 may be provided on the rear end of the bottom surface 211 without having the inclined surface 212. Also, the inclined surface 212 and/or the rear surface 213 may be called a bending part.

A plurality of coupling holes 211*a* and 211*b* may be defined in the bottom surface 211. The coupling holes 211*a* and 211*b* may include a valve unit coupling hole 211*a* in which the valve unit 26 is mounted and a knob unit coupling hole 211*b* in which the knob unit 25 is mounted. Thus, the corresponding manipulation member 143 may be freely disposed according to the arrangement of the various cooking modules 30 provided in the module mounting space 201.

In the coupling holes 211*a* and 211*b*, the coupling holes 211*a* and 211*b* for fixing at least the valve unit 26 and knob unit 25 may be commonly defined in a portion corresponding to a unit area of the bottom surface 211 that is partitioned by the unit length L. Thus, when each of the cooking modules 30 are disposed on the unit area S, the corresponding valve unit 26 and the corresponding knob unit 25 may be mounted on the bottom surface at the desired positions.

The knob unit coupling hole 211*b* may be defined in the front end of the base plate 21. Also, the knob unit coupling hole 211*b* may be defined in a position corresponding to a knob unit coupling part 251 provided on the lower end of the knob unit 25. The knob unit coupling part 251 may be provided in plurality.

The valve unit coupling hole 211*a* may be defined in a rear side of the knob unit coupling hole 211*b*. The valve unit coupling hole 211*a* may be defined so that a separate valve bracket 261 for fixing the valve unit 26 is mounted. A bracket fixing part may be provided on the valve bracket 261 and inserted into the valve unit coupling hole 211*a*.

Also, a bracket coupling hole 262 may be defined in a position corresponding to at least a portion of the knob unit coupling hole 211*b* to allow the valve bracket 261 to be further fixed to the base plate 21 through a screw.

As described above, the valve unit 26 and the knob unit 25 may be selectively mounted at the same position of the base plate 21 by the arrangement of the knob unit coupling hole 211*b* and the valve unit coupling hole 211*a*. That is, the knob unit 25 and the valve unit 26 may be selectively mounted at the same position according to the arrangement of the cooking modules 30.

As necessary, the coupling holes 211*a* and 211*b* may further a hole for mounting the module bracket 70. Alternatively, the module bracket 70 may be mounted at a set position by using the screw without being previously formed as a separate hole.

An air hole 214 may be further defined in the inclined surface 212. The air hole 214 may be defined at the same position in each unit area as a hole for discharging the heat within the cooktop part 20. The air hole 214 may communicate with an inner space of the exhaust part 13. Thus, air cooling the cooktop part 20 may be exhausted through the exhaust part 13. The exhaustion may be performed in the unit area S regardless of the kinds of cooking modules 30. The air introduced into the cooktop part 20 to cool the inside of the cooktop part 20 may be exhausted to the exhaust part 13.

Also, a tube hole 215 may be further defined in the inclined surface 212. The tube hole 215 may be a hole through which a gas tube 500 connected to the burner module 50 is accessible when the burner module is mounted. The tube hole 215 may be defined in the central unit area S on which the burner module 50 is mainly disposed. As necessary, the tube hole 215 may be defined in each of the unit areas S. When the tube hole 215 is defined in each of all the unit areas S, the burner module 50 may be mounted on each of all the unit areas S of the cooktop part 20.

Also, an upper air hole 216 may be further defined in the rear surface 213. The upper air hole 216 may be configured to exhaust the heat generated in the cooking modules or the cooling air. The upper air hole 216 may be opened to correspond to the rear surface of the sous vide module 40, the induction module 60, or the griddle module 80.

The upper air hole 216 may also communicate with the inside of the exhaust part 13. Thus, the heat generated in the cooking modules 30 and the cooling air may be discharged together through the exhaust part 13.

At least one of the air hole 214, the tube hole 215, and the upper air hole 216 may be called a base opening. The base opening may be defined in the inclined surface and/or the rear surface 213 and provided for each of the unit areas S. Also, the base opening may be configured so that the exhaust of the cooling air and the access of a wire and the gas tube are enabled at the same time.

The rear support 24 may be disposed on the upper end of the rear surface 213. The rear support 24 may be configured to support the rear ends of the cooking modules 30 mounted on the cooktop part 20. For this, the rear support 24 may be disposed on the upper end of the rear surface 213 in a stepped shape. The rear support 24 may be manufactured by bending the upper end of the rear surface of the base plate 21 or may be separately molded to be mounted on the upper end of the rear surface of the cooktop part 20.

The rear support 24 may include a rear seating part 241 extending backward and a rear extension part 242 extending upward from a rear end of the rear seating part 241. The rear end of the cooking module may be seated to contact each of the rear seating part 241 and the rear extension part 242.

A rear bracket mounting part 243 into which a rear end of the burner bracket 72 is inserted may be provided on the rear support 24. The rear bracket mounting part 243 may be provided on a central portion of each of the unit areas S. Thus, the mounting of the burner bracket 72 and the supporting of the burner module 50 may be enabled even any unit area within the cooktop part 20.

Also, A rear deco mounting part 244 into which a rear end of the deco member 28 is inserted may be provided on the rear support 24. The rear deco mounting part 244 may be opened or recessed in a shape corresponding to the rear end of the deco member 28. Also, the rear deco mounting part 244 may be disposed between the adjacent unit areas S within the cooktop part 20. Thus, when the deco member 28 is mounted, the deco member 28 may partition both unit areas S from each other.

An auxiliary mounting part 245 may be further provided on each of both sides adjacent to the rear deco mounting part 244. The auxiliary mounting part 245 may allow one side of the grating 520 of the burner module 50 to be inserted therein so that the mounted state of the grating 520 is maintained.

Figure 9:
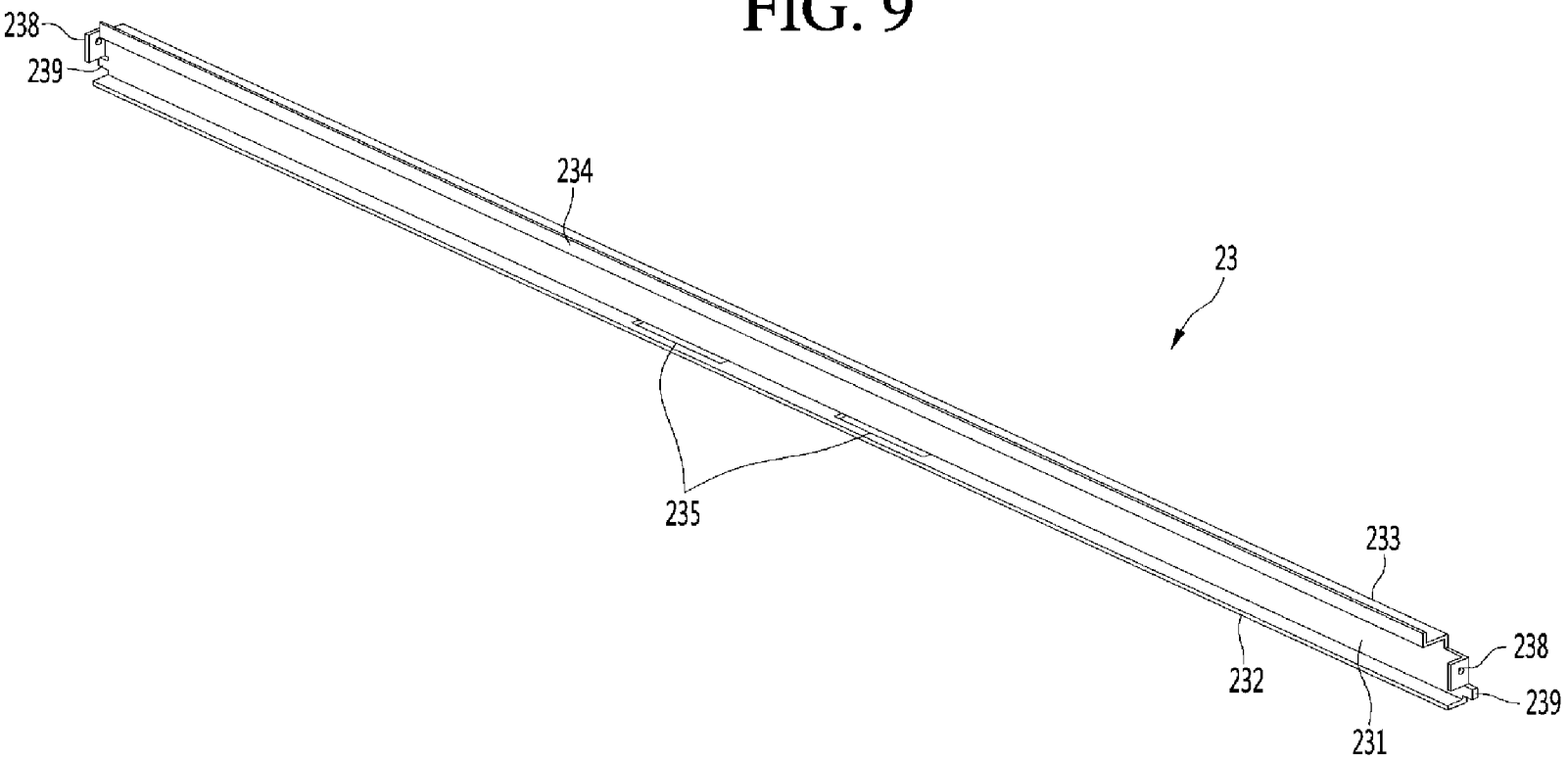
FIG. 9 is a front perspective view of a front support that is one component of the cooktop part.
Figure 10:
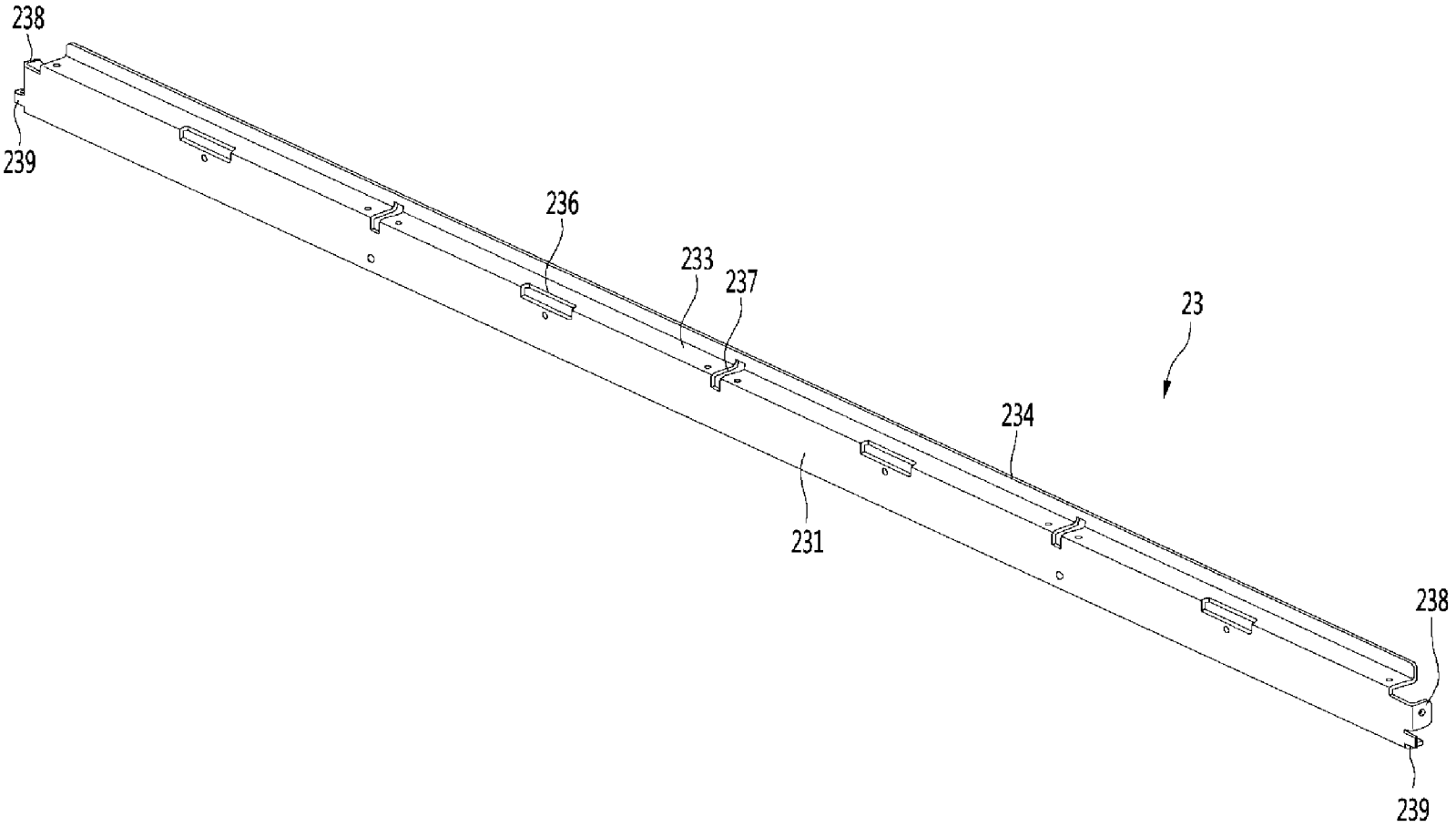
FIG. 10 is a rear perspective view of the front support.

FIG. 9 is a front perspective view of the front support that is one component of the cooktop part. FIG. 10 is a rear perspective view of the front support.

As illustrated in the drawings, the front support 23 may have a length corresponding to the horizontal length of the cooktop part 20. Also, the front support 23 may be mounted to face the rear support 24 to support the front end of the cooking module 30 mounted on the cooktop part 20.

A support coupling part 238 coupled to the side plate 22 may be disposed on each of both side ends of the front support 23. The support coupling part 238 may be bent and coupled to the side plate 22 through coupling of the screw. Also, a coupling protrusion 239 further protruding from the support coupling part 238 may be disposed on each of both side ends of the front support. The coupling protrusion 239 may be inserted to pass through the side plate.

Also, a central portion 231 facing the rear surface of the base plate 21 may be disposed at a center of the front support 23, and a front bent part 232 that is bent forward may be disposed on a lower end of the central portion 231. The front seating part 233 may be disposed on an upper end of the central portion 231, and the front extension part 234 may be disposed on a front end of the front seating part 233.

Also, a PCB mounting hole 235 in which the display PCB 27 is mounted may be defined in a center of the front bent part 232. A mounting protrusion of an upper end of the display PCB 27 may be inserted into the PCB mounting hole 235. Thus, the display PCB 27 may be fixed and mounted on the lower end of the front support 23. The display PCB 27 may be coupled in a state of being coupled to a separate case, and the case may be coupled to the PCB mounting hole 23. The display PCB 27 may be disposed at a rear side of the display 142 in the state of being mounted.

The front seating part 233 may be bent and extend forward from an upper end of the central portion 231. The front seating part 233 may extend in the same direction as the front bent part 232 in a parallel to each other. Also, a front extension part 234 bent upward may be disposed on an extending end of the front seating part 233. The front support 23 may have a stepped surface by the front seating part 233 and the front extension part 234 to provide a surface on which the front end of the cooking module 30 is seated.

A front bracket mounting part 236 into which the front end of the burner bracket 72 is inserted may be disposed on an edge on which the central portion 231 and the front seating part 233 contact each other. The front bracket mounting part 236 may be provided on each of central portions of the unit areas at a position facing the rear bracket mounting part 243.

Also, a front deco mounting part 237 may be disposed on the front seating part 233. The front deco mounting part 237 may have a shape corresponding so that the front end of the deco member 28 is inserted into the front deco mounting part 237. Also, the front deco mounting part 237 may be disposed at a position facing the rear deco mounting part 244.

Each of the front bracket mounting part 236, the rear bracket mounting part 243, the front deco mounting part 237, the rear deco mounting part 244, and the auxiliary mounting part 245 may be provided in a hole or groove shape.

When the manipulation part 14 is mounted, the front support 23 may be covered by the manipulation part 14 or accommodated in the manipulation part 14. That is, the front support 23 may be covered by the manipulation panel 141.

Also, in the state in which the front support 23 is mounted, the front support 23 and the rear support 24 may substantially support the front and rear ends of each of the cooking modules 30. A common support structure may be provided so that the cooking modules 30 are disposed on the desired unit areas S within the cooktop part 20 by the front support 23 and the rear support 24.

In detail, the inside of the cooktop part 20 may be partitioned into a plurality of unit areas S so that the plurality of cooking modules 30 are mounted. One unit area S may be a space in which one cooking module is mounted, and the unit areas S may be disposed on the cooktop part 20 in parallel to each other. That is, the space between the front support 23 and the rear support 24 may be continuous to form the unit area S disposed in the horizontal direction.

Each of the front and rear ends of each of the unit area S may have a common mounting structure so that any cooking module 30 of the plurality of cooking modules 30 is mounted on each unit area S. However, the module bracket 70 for supporting the cooking module 30 may be disposed on the base plate 21 with a structure corresponding to each of the cooking modules 30.

Figure 11:
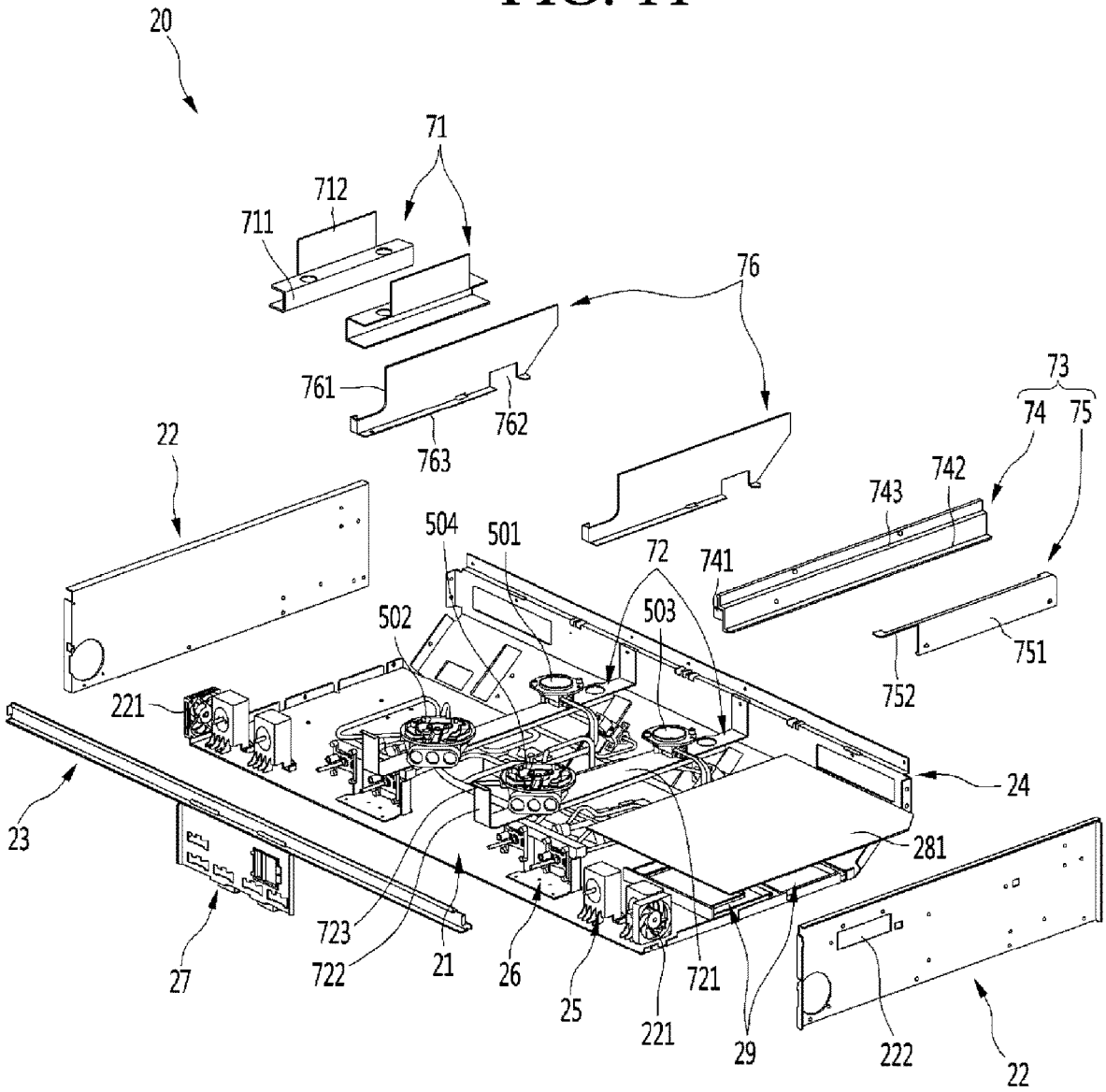
FIG. 11 is an exploded perspective view illustrating a coupling structure of brackets for mounting the cooking module.
Figure 12:
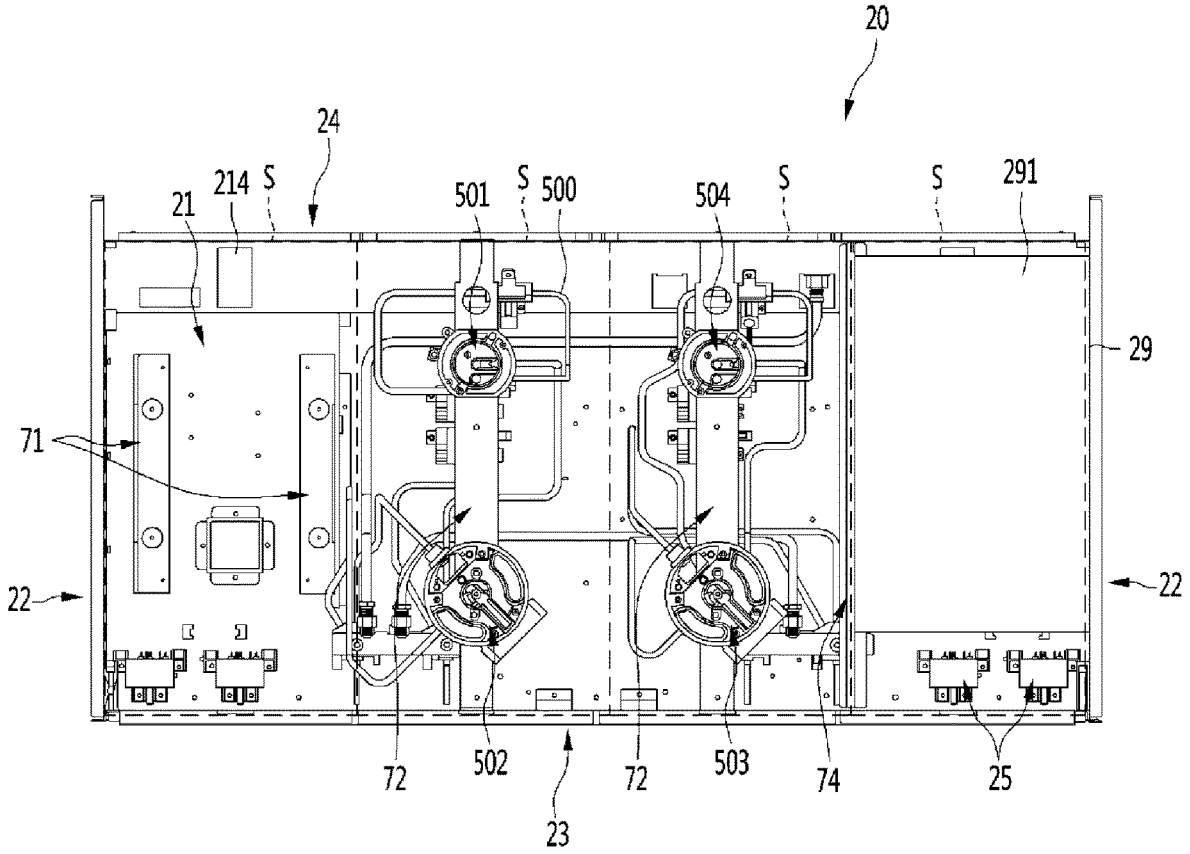
FIG. 12 is a plan view illustrating the inside of the cooktop part.
Figure 13:
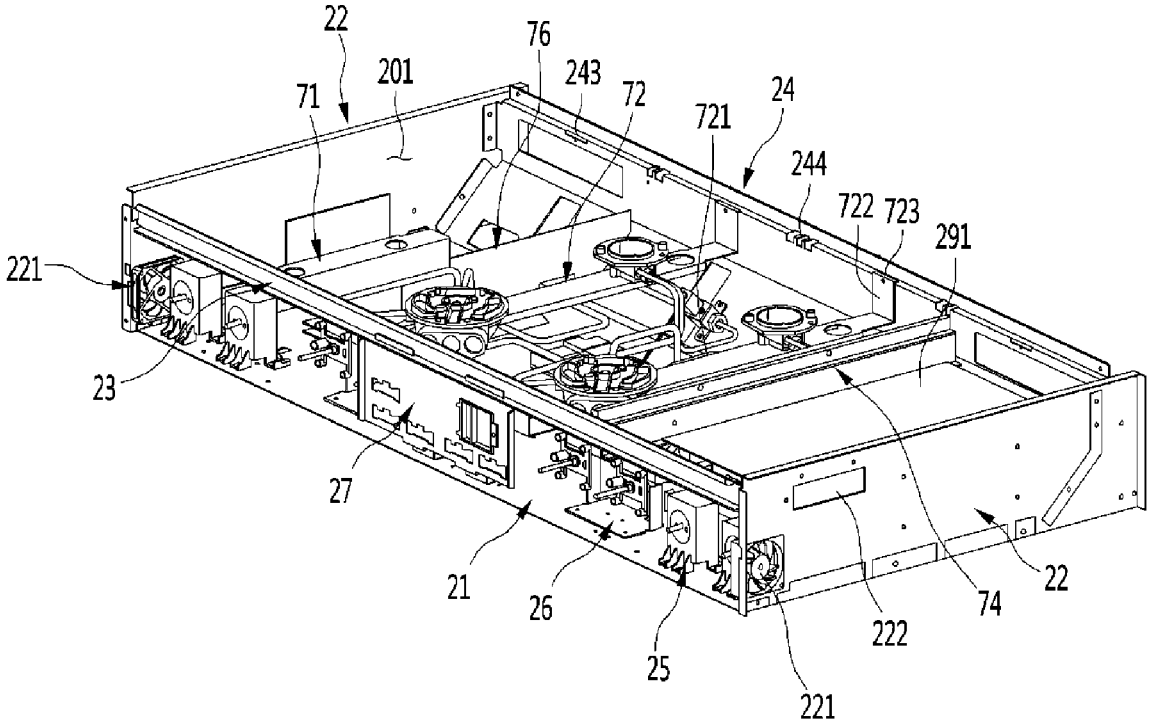
FIG. 13 is a perspective view illustrating the inside of the cooktop part.
Figure 14:
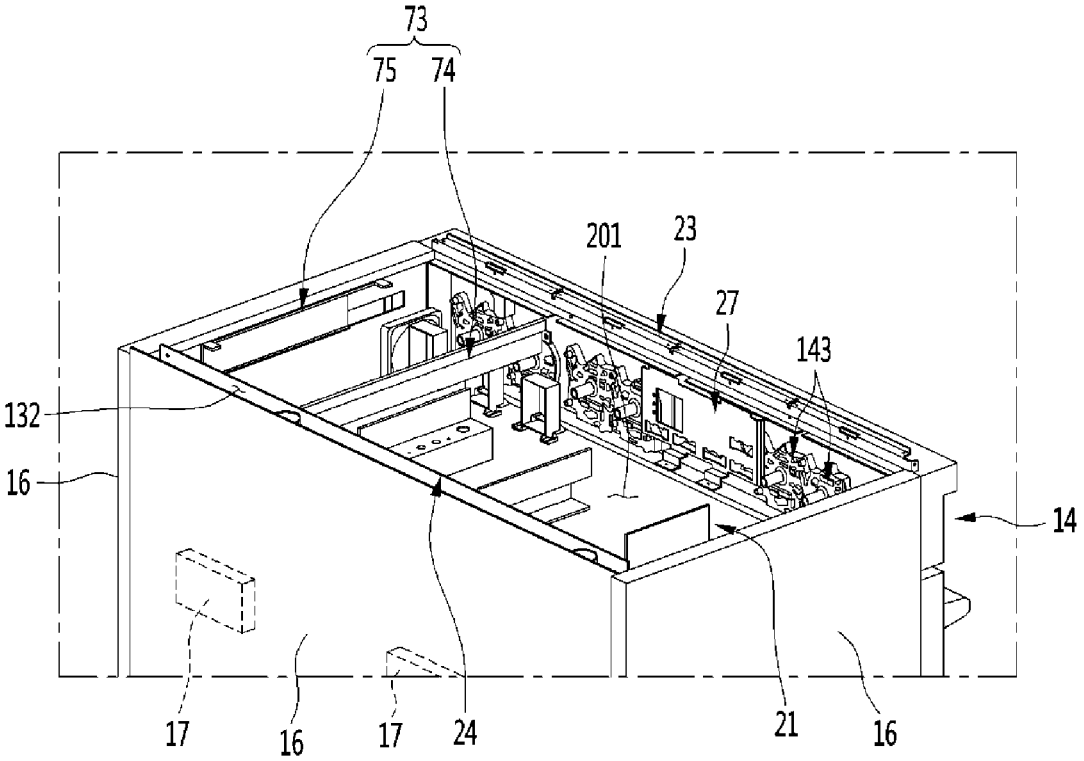
FIG. 14 is a rear view of the cooktop part in a state in which the cooking module is separated.

FIG. 11 is an exploded perspective view illustrating a coupling structure of the brackets for mounting the cooking module. Also, FIG. 12 is a plan view illustrating the inside of the cooktop part. Also, FIG. 13 is a perspective view illustrating the inside of the cooktop part. Also, FIG. 14 is a rear view of the cooktop part in a state in which the cooking module is separated.

Referring to the drawings, a plurality of module brackets for supporting the cooking modules 30 and an insulation plate 76 may be mounted inside the module mounting space 201. In this embodiment, a structure in which the burner module 50 is disposed on the center of the cooktop part 20, and the sous vide module 40 and the induction module 60 are disposed on both left and right sides of the cooktop part 20 will be described. However, the cooking modules 30 may be changed in arrangement and number as necessary.

In the burner module 50, four burners 501, 502, 503, and 504 may be disposed at the center of the inside of the cooktop part 20. To mount the burner module 50, a pair of burner brackets 72 may be mounted on the cooktop part 20. Both ends of each of the burner brackets 72 may be bent so that front and rear ends of the burner bracket 72 are respectively inserted into and fixed to the front support 23 and the rear support 24. The front bracket mounting part 236 and the rear bracket mounting part 243 into which both the ends of the burner bracket 72 are inserted may be disposed on each of the unit area S on the front support 23 and the rear support 24.

The burner bracket 72 may include a burner support 721 that extends forward and backward to support a lower portion of the burner, a burner bracket bent part 722 bent upward from each of both ends of the burner support 721, and a burner bracket insertion part 723 bent forward or backward from an upper end of the burner bracket bent part 722 and inserted into the front bracket mounting part 236 and the rear bracket mounting part 243.

Since the burner bracket 72 is mounted, the burner module 50 may be supported from a lower side, and a lower end of the burner module 50 may be spaced apart from the base plate 21.

The burner bracket 72 may be provided one by one on the two unit areas S that are successively disposed at the center of the cooktop part 20. Thus, the burner module 50 may include the four burners 501, 502, 503, and 504 and be disposed to occupy the two unit areas S.

The insulation plate 76 may be disposed between the unit area S on which the burner module 50 is disposed and the unit area S on which the other cooking module 30 is disposed. The insulation plate 76 may be disposed on a boundary between the unit areas S adjacent to each other. Also, the insulation plate 76 may extend from the base plate 21 up to the lower end of the cooking module 30 and also extend from the front end to the rear end of the module mounting space 201 to partition the unit area S. That is, the insulation plate 76 may partition the inner space of the cooktop part 20 to prevent the heat generated in each of the cooking modules 30 from being directly transferred to the adjacent cooking module 30.

Also, the air guide 761 through which the cooling air blown by the cooling fan 221 mounted on the side plate 22 passes may be disposed on a front end of the insulation plate 76. The air guide 761 may be provided by cutting a position corresponding to the cooling fan 221 to allow the cooling air to smoothly flow.

Also, a through-part 762 through which the wire or the gas tube are accessible may be defined in the insulation plate 76. Also, the rear end of the insulation plate 76 may have a shape corresponding so that the rear end contacts the inclined surface 212 and the rear surface 213 of the base plate 21.

Also, a plate coupling part 763 bent outward to allow the insulation plate 76 to be fixed and mounted on the base plate 21 may be disposed on the lower end of the insulation plate 76.

The sous vide bracket 71 may be provided on a left side of the burner module 50 so that the sous vide module 40 is mounted. The sous vide bracket 71 may be fixed and mounted on the bottom surface 211 of the base plate 21 to support the sous vide module 40 at a lower side.

The sous vide bracket 71 may support the bottom surface of the sous vide module 40. When the sous vide module 40 is mounted, the sous vide bracket 71 may have a height corresponding so that the sous vide module 40 has the same height as the other cooking modules 30.

The sous vide bracket 71 may have a size that is enough to be disposed inside each unit area S, and the sous vide module 40 may be mounted on each unit area S.

The sous vide bracket 71 may be provided in a pair having the same structure and thus be respectively disposed on both left and right sides of the sous vide module 40. Also, the sous vide bracket 71 may include a sous vide support 711 and a sous vide insulation part 712. The sous vide support 711 may have a predetermined height. A bottom surface of the sous vide support 711 may allow the sous vide bracket 71 to be fixed to the base plate 21 by a coupling member. Also, a top surface of the sous vide support 711 may contact the bottom surface of the sous vide module 40 to support the sous vide module 40 and be coupled to the sous vide module 40 by the coupling member.

Also, front and rear ends of the sous vide module 40 may be seated on the front support 23 and the rear support 24.

The sous vide insulation part 712 extending upward may be disposed on an outer end of the sous vide support 711.

The sous vide insulation part 712 extends to a predetermined height and is disposed on each of both left and right sides of the sous vide module 40. Also, the sous vide insulation part 712 may be configured to prevent the heat generated when the sous vide module 40 operates from being transferred to the adjacent cooking module or an electric component associated with the cooking module 30.

Also, the sous vide bracket 71 and the insulation plate 76 may be provided together on each unit area S. When the insulation plate 76 and the sous vide insulation part 712 are disposed in parallel to each other, a structure in which two plates overlap each other may be provided to more effectively insulate the unit areas S from each other.

The induction bracket 73 for mounting the induction module 60 may be provided on the rightmost unit area S of the cooktop part 20. Electric components such as a working coil 64 and an induction PCB 65 may be filled in the induction module 60. Thus, since the screw does not pass through the induction module 60, the induction module 60 may not be coupled by using the screw. Thus, the induction module 60 may be supported by the induction bracket 73 at both left and right sides of the induction module 60.

The induction bracket 73 may be constituted by a first bracket 74 and a second bracket 75 to support both ends of the induction module 60.

The first bracket 74 may extend to connect the rear support 24 to the front support 23. The induction bracket coupling part 741 coupled to each of the front support 23 and the rear support 24 may be disposed on each of front and rear ends of the first bracket 74. The screw may be coupled to the induction bracket coupling part 741.

Also, a lower seating part 742 and an upper seating part 743, which are stepped, may be disposed on an inner surface of the first bracket 74. A shield member 291 that will be described below may be seated on the lower seating part 742. Also, the upper seating part 743 may support a lower end of a side surface of the induction module 60.

A flange 744 bent outward may be further provided on an upper end of the first bracket 74. An induction frame 62 defining a side surface of the induction module 60 may be seated on the flange 744. Thus, the induction module 60 may have a stable support structure without being fixed by a separate screw.

The second bracket 75 may be disposed on a side surface facing the first bracket 74 and be fixed and mounted on the inner surface of the side plate 22 by the screw. The second bracket 75 may be configured to support the other side of the induction module 60.

The second bracket 75 may include a bracket fixing part 751 fixed to the inner surface of the side plate 22 and a bracket support 752 bent from an upper end of the induction bracket fixing part 751 to extend to a side end of the induction module 60.

The bracket support 752 may protrude toward one side surface of the induction module 60 to pass through the side surface of the induction module 60, thereby restricting the induction module 60. Thus, when the induction module 60 is mounted, the second bracket 75 and the one side surface of the induction module 60 may be coupled to each other, and the other end of the induction module 60 may be seated on the first bracket 74.

The induction module 60 may also be spaced apart from the base plate 21 by the induction bracket 73. Thus, the induction module 60 may cool by the cooling air flowing through the inside of the cooktop part 20.

A cold air inflow hole 222 may be further defined in one side of the side plate 22 on which the second bracket 75 is mounted. The cold air inflow hole 222 may communicate with an opening of one side of the induction module 60 to allow the cooling air to be introduced into the induction module 60. The cold air may cool the inside of the induction module 60 and then be discharged to the exhaust part 13.

Also, the shield member 291 may be provided between the first bracket 74 and the second bracket 75. The shield member 291 may be provided as a plate or flexible sheet. The shield member 291 may be disposed below the induction module 60 to prevent heat or electromagnetic waves of the induction module 60 from being penetrated into the control PCB 29 that is disposed therebelow.

The control PCB 29 may be disposed below the induction module 60. The control PCB 29 may be configured to control an operation of the cooking module 30 provided in the cooktop part 20. The induction module 60 may be separated so that the user is easily accessible to the control PCB 29.

Hereinafter, a mounted state and structure of each of the cooking modules will be described in detail with reference to the accompanying drawings.

Figure 15:
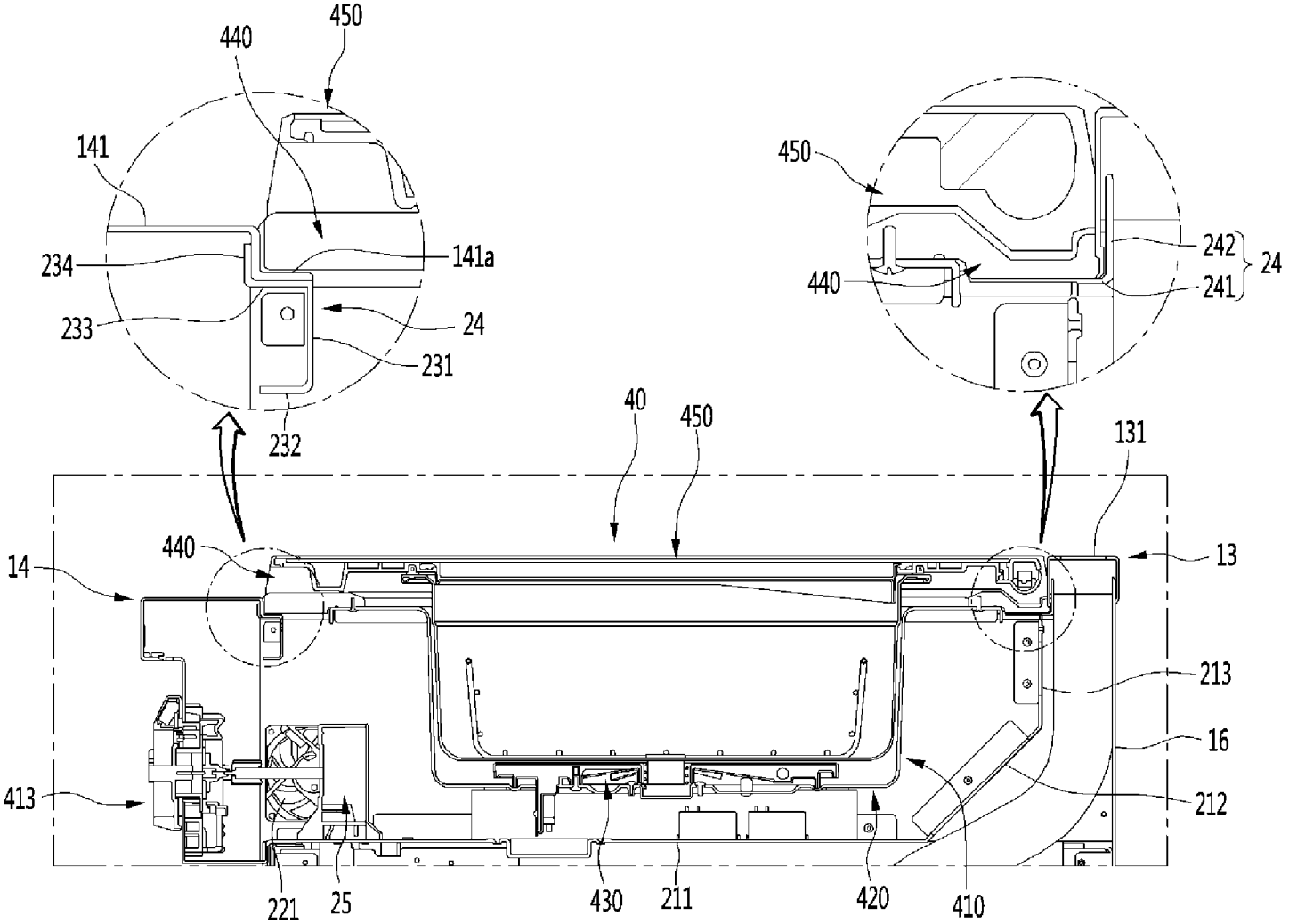
FIG. 15 is a cross-sectional view taken along line 15-15' of FIG. 1.

FIG. 15 is a cross-sectional view taken along line 15-15' of FIG. 1.

As illustrated in the drawing, the sous vide module 40 may be disposed on the leftmost unit area S of the cooktop part 20. The sous vide module 40 includes a housing 410 which defines an outer appearance of the sous vide module 40 and in which a container 420 for the sous vide cooking is accommodated. A heating part 430 including a heater may be disposed on a bottom surface of the housing 410. The heating part 430 may contact a bottom surface of the container 420 to heat the container 420.

Also, the sous vide frame 440 defining a circumference of an outer appearance of a top surface of the housing 410 may be disposed on the top surface of the housing 410, and the sous vide door 450 may be provided in the sous vide frame 440. When the sous vide door 450 is closed, the inside of the housing 410 and the container 420 may be sealed, and thus, food accommodated in the container 420 may be cooked through the sous vide cooking. Also, at least a portion of the sous vide door 450 may be transparent so that the user confirms a cooked state of the food within the container 420.

The sous vide module 40 may be fixed and mounted on the sous vide bracket 71 by the screw coupled to the inside of the housing 410. Here, the bottom of the housing 410 may be spaced apart from the base plate 21 by a height of the sous vide support 711. As a result, the constituents protruding to the outside of the housing 410 may not interfere with the base plate 21, and thus, the wire connected to the heating part 430 may be easily disposed.

Also, the sous vide insulation part 712 may shield at least a portion of each of the both side surfaces of the housing 410 to minimize the heat transfer to both sides.

The front and rear ends of the sous vide module 40 may be supported by the front support 23 and the rear support 24, respectively. Particularly, an edge of a lower end of the front surface of the sous vide frame 440 may be seated on the front seating part 233, and an edge of a lower end of the rear surface of the sous vide frame 440 may be seated on the rear seating part 241. Thus, the sous vide module 40 may be stably mounted on the cooktop part 20.

A panel bent part **141*a* that is bent in a shape corresponding to the front seating part 233 may be disposed on a rear end of the manipulation panel 141 constituting the manipulation part 14. The panel bent part 141*a* may overlap the front seating part 233. Here, the sous vide module 40 may be seated on the panel bent part 141***a* of the rear end of the manipulation panel 141.

Alternatively, when the sous vide bracket 71 moves to be mounted on the other unit area S, the sous vide module 40 may move together to be installed.

Figure 16:
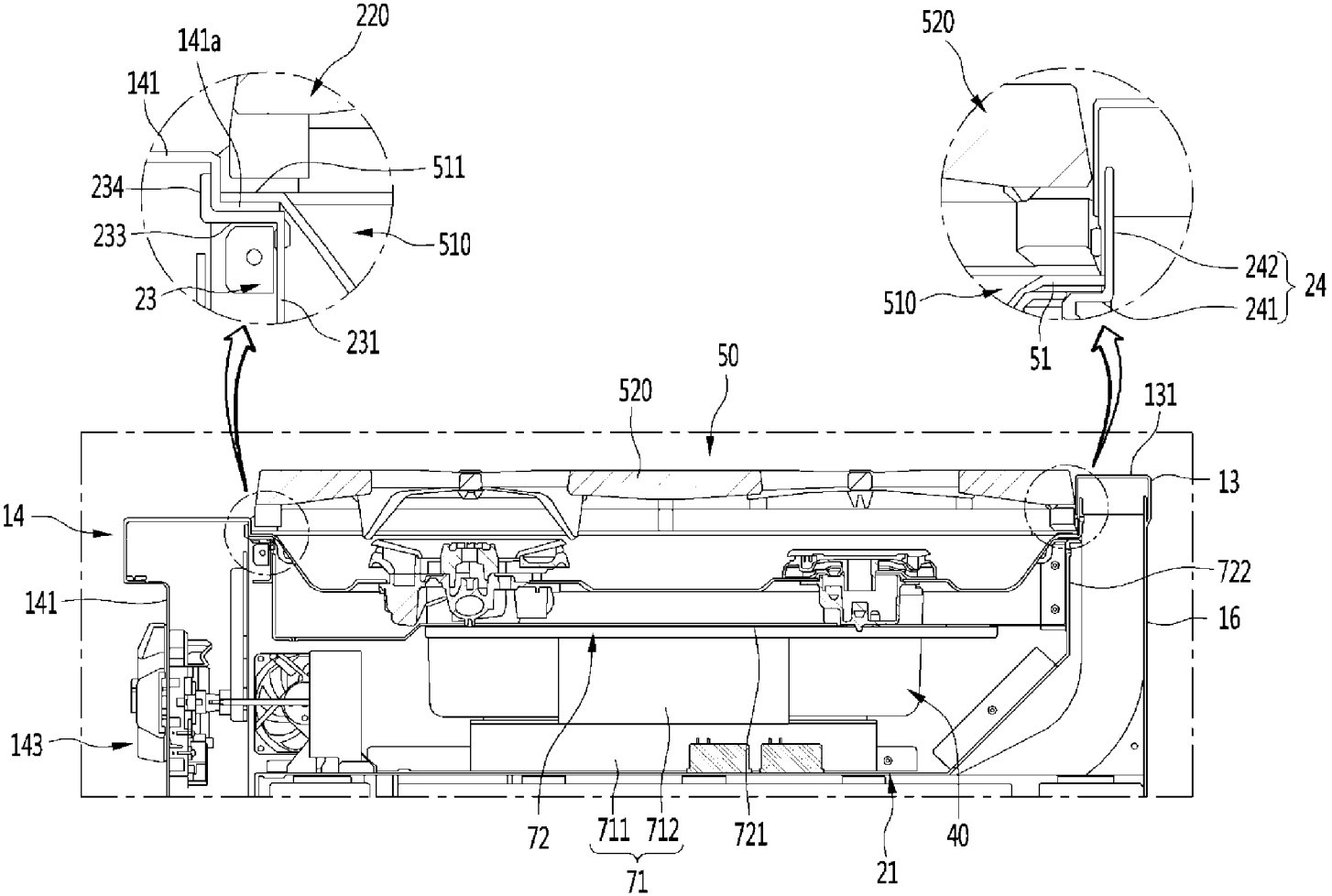
FIG. 16 is a cross-sectional view taken along line 16-16' of FIG. 1.
Figure 17:
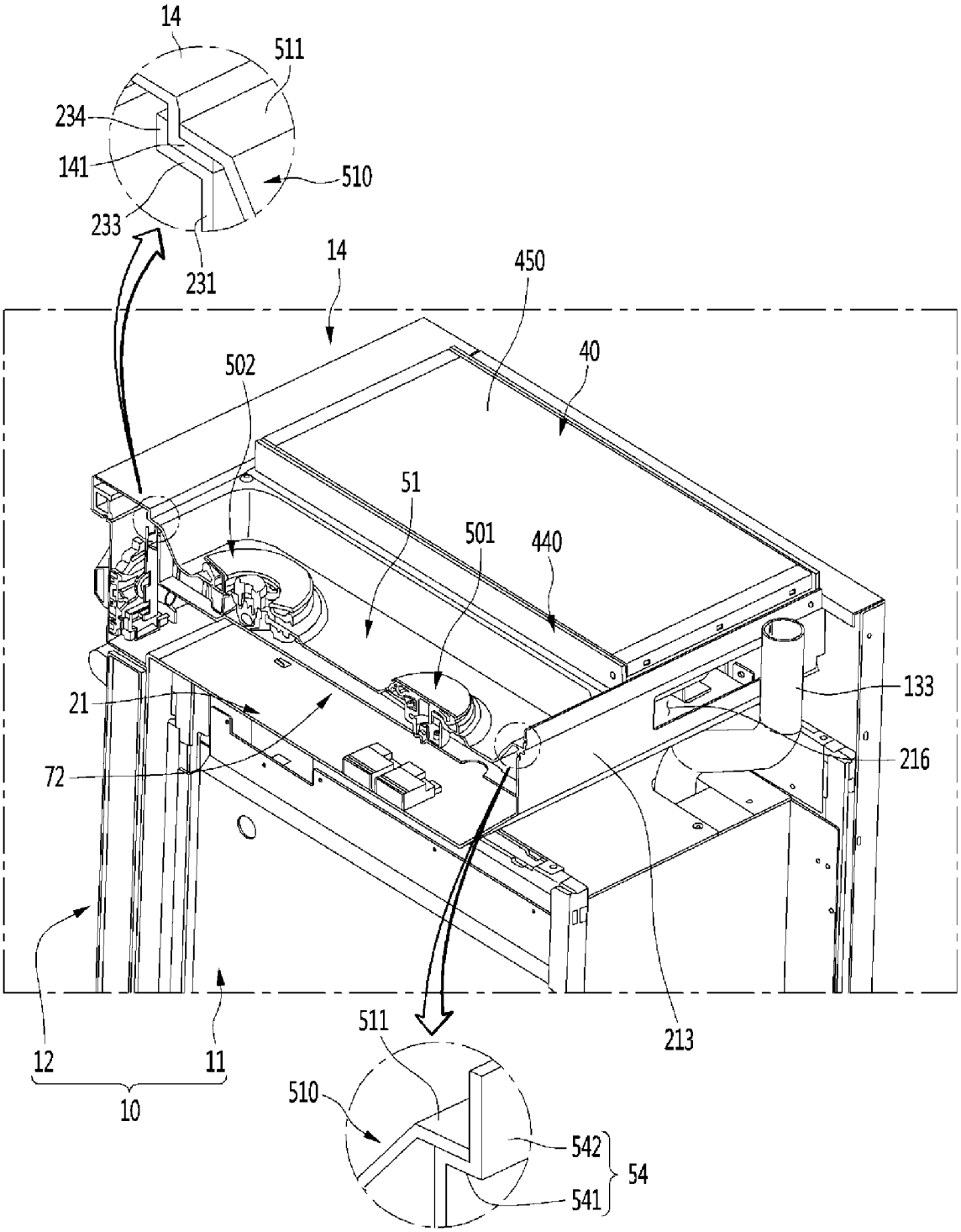
FIG. 17 is a cutaway perspective view illustrating a state in which a burner module of the cooking module of the cooktop part is mounted.

FIG. 16 is a cross-sectional view taken along line 16-16' of FIG. 1. Also, FIG. 17 is a cutaway perspective view illustrating a state in which the burner module of the cooking module of the cooktop part is mounted.

As illustrated in the drawing, the burner module 50 may be disposed on the cooktop part 20 adjacent to the sous vide module 40.

The burner module 50 may include the burner plate 510 and the burners 501, 502, 503, and 504 mounted on the burner plate 510. The burner plate 510 may have a size that is enough to shield two unit areas or shield one unit area so that two burner plates 510 are connected in parallel to each other.

Also, front and rear ends of the burner plate 5109 may be supported by the front seating part 233 of the front support 23 and the rear seating part 241 of the rear support 24, respectively.

Also, lower ends of the burners 501, 502, 503, and 504 may be supported by the burner bracket 72. The front end rear ends of the burner bracket 72 may support portions of front and rear portions of the bottom surface of the burner plate 510. Thus, the burner plate 510 and the burners may be supported by the burner bracket 72 at the same time.

When the burner module 50 is spaced apart from the base plate 21 by the burner bracket 72, a space in which the gas tube 500 connected to the burners 501, 502, 503, and 504 may be defined between the bottom surface of the burner module 50 and the base plate 21.

The panel bent part 141*a* that is bent in a shape corresponding to the front seating part 233 may be disposed on the rear end of the manipulation panel 141 constituting the manipulation part 14. The panel bent part 141*a* may overlap the front seating part 233. Here, an outer end 511 of the burner plate 510 of the burner module 50 may be seated on the panel bent part 141*a* of the rear end of the manipulation panel 141.

When the burner bracket 72 moves to be mounted on the other unit area S, the burner module 50 may also move together to be installed.

A screw may be coupled to each of four edges of the burner plate 510. The screw may pass through the burner plate 510 and be coupled to the front support 23 or the rear support 24. Thus, the burner module 50 may be maintained in the completely fixed state on the cooktop part 20.

Also, the burner module 50 may the grating 520. The grating 520 may be mounted on the burner plate 510 to support the container for the heating at the upper side of the burners 501, 502, 503, and 504. The grating 520 may be made of the same cast iron material as the sous vide frame 440. Also, the grating 520 may have the same height as each of the sous vide door 450 of the sous vide module 40 and the top plate 63 of the induction module 60.

The grating 520 may be filled in a space defined between the sous vide module 40 and the induction module 60, which are disposed on both left and right sides of the cooktop part 20, to allow the cooktop part 20 to realize the sense of unit as a whole.

Figure 18:
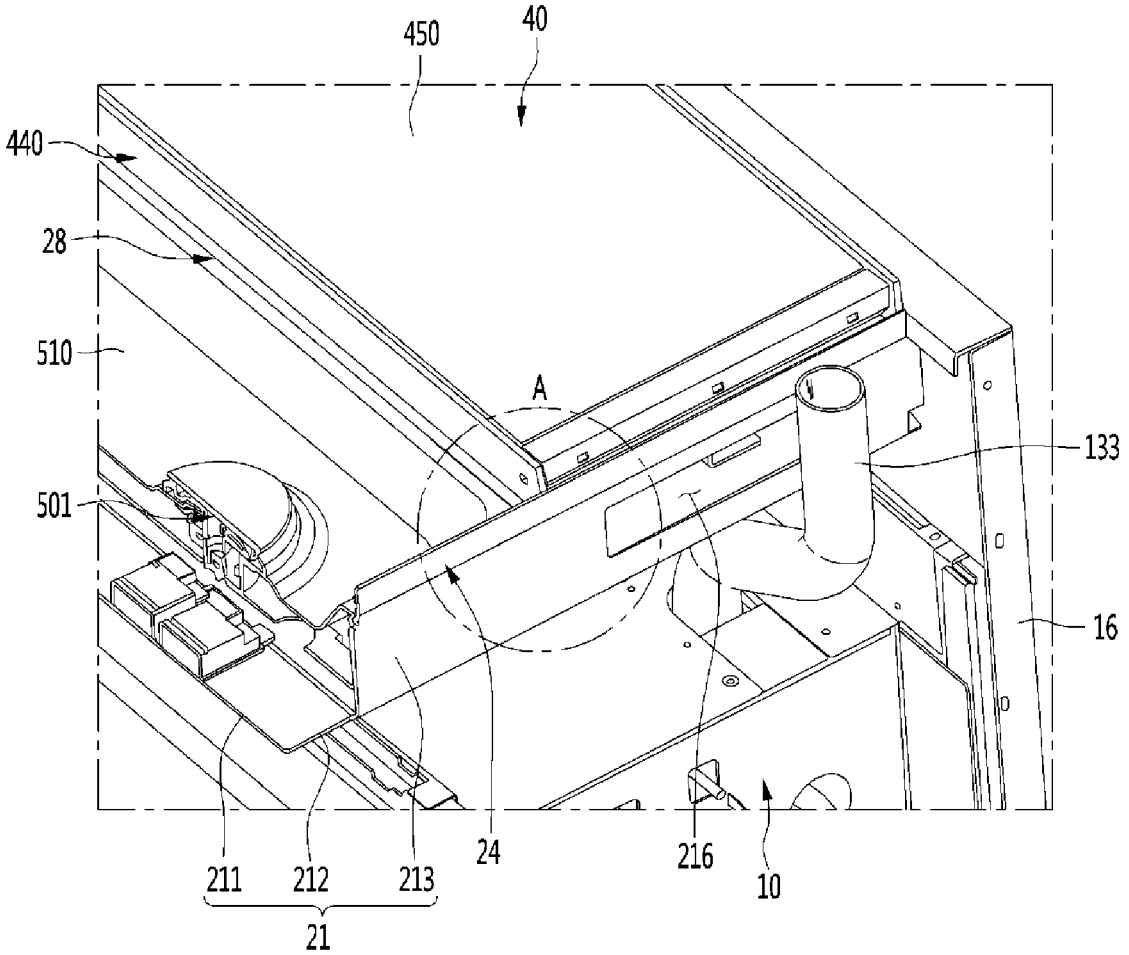
FIG. 18 is a perspective view illustrating a deco member mounted on the cooktop part.
Figure 19:
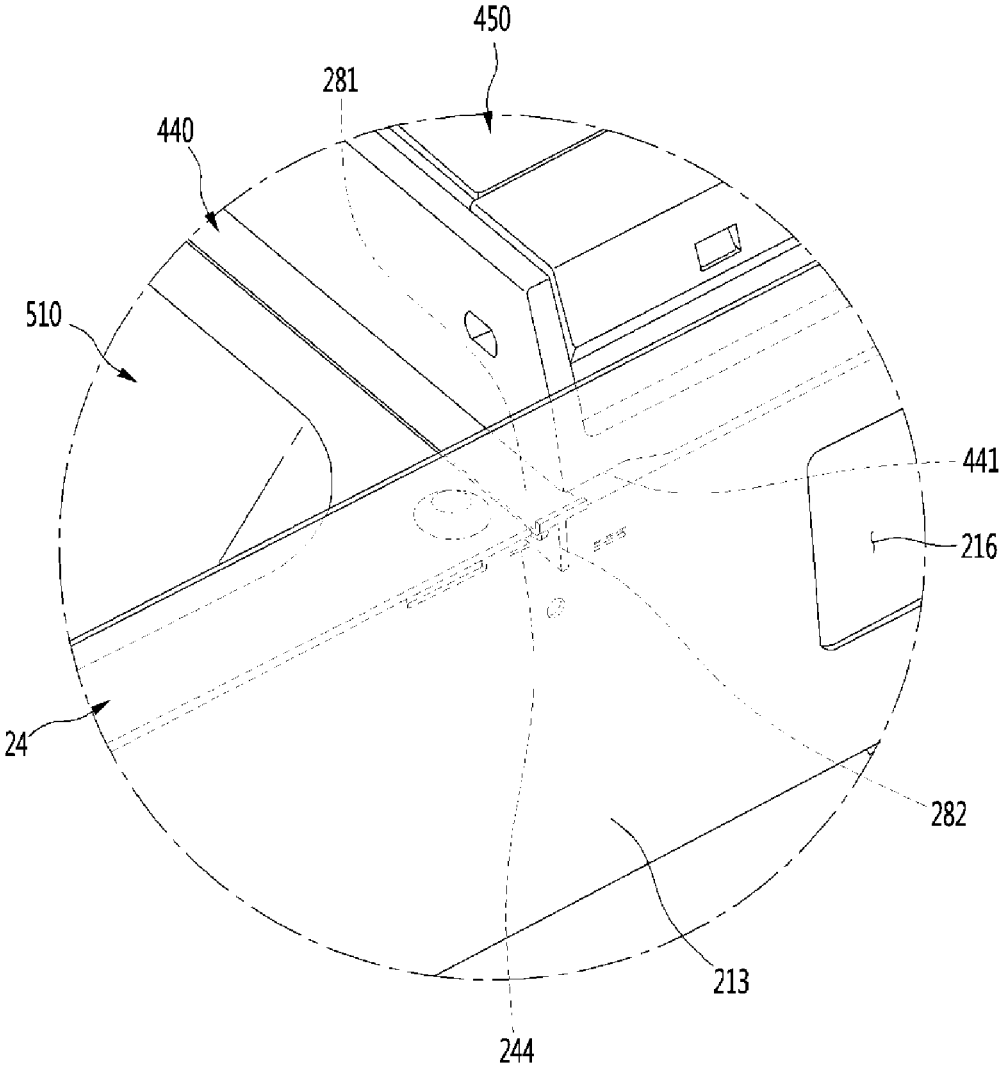
FIG. 19 is a partial perspective view illustrating a state in which the cooking module is mounted on the cooktop part.
Figure 20:
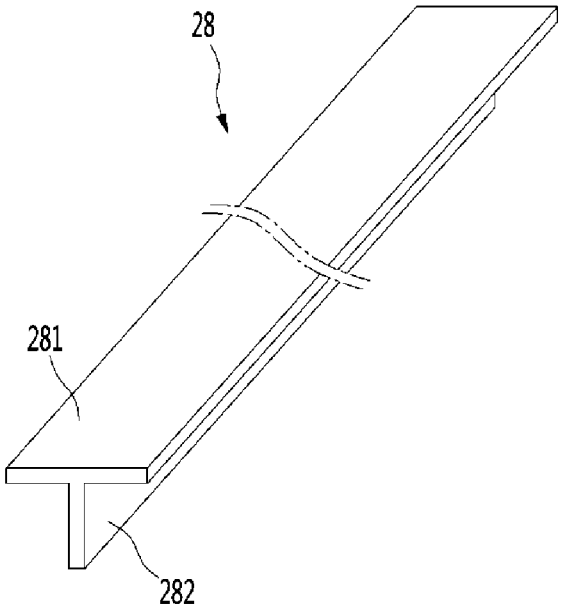
FIG. 20 is an enlarged projective view of a portion A of FIG. 19.

FIG. 18 is a perspective view illustrating the deco member mounted on the cooktop part. Also, FIG. 19 is a partial perspective view illustrating a state in which the cooking module is mounted on the cooktop part. Also, FIG. 20 is an enlarged projective view of a portion A of FIG. 19.

As illustrated in the drawings, in the state in which the cooking modules 30 are mounted on the cooktop part 20, a gap may be generated between the cooking modules 30 adjacent to each other. Here, the deco member 28 may cover the gap between the cooking modules 30.

In the state in which the burner plate 510 is fixed to be mounted, a gap between a side end of the sous vide module 40 and a side end of the induction module 60, which are disposed on both left and right sides and both the side ends of the burner plate 510. Due to the occurrence of the gap, the inside of the cooktop part 20 may occur leakage of the heat within the cooktop part 20 or penetration of foreign substances into the cooktop part 20 as well as deterioration of the appearance of the cooktop part 20.

The deco member 28 may be mounted on both the left and right side ends of the burner plate 510 to contact the side end of the sous vide module 40 and the side end of the induction module 60. Thus, the gas between the sous vide module 40 and the induction module 60, which contact the burner module 50, may be covered.

In detail, the deco member 28 may be mounted on the cooktop part 20 to partition the module mounting space 201 into the plurality of unit areas S. A front end of the deco member 28 may be mounted on the front support 23, and a rear end of the deco member 28 may be mounted on the rear support 24.

The deco member 28 may be constituted by a cover part 281 and a partition part 282. The cover part 281 may have a plate shape having a predetermined width to cover the gap between the cooking modules 30. Also, the partition part 282 extending downward may be disposed on a center of a bottom surface of the cover part 281.

The partition part 282 may extend from a front end to a rear end of the cover part 281. Also, when the deco member 28 is mounted, the front end of the partition part 282 may be inserted into the front deco mounting part 237, and the rear end of the partition part 282 may be inserted into the rear deco mounting part 244.

Each of the front deco mounting part 237 and the rear deco mounting part 244 may have a slit shape having a depth at which the partition part 282 is completely inserted. Thus, in the state in which the partition part 282 inserted into the front deco mounting part 237 and the rear deco mounting part 244, the deco member may not easily move or be easily separated.

In detail, in the state in which the deco member 28 is mounted, as illustrated in FIG. 20, the partition part 282 may be inserted into the front deco mounting part 237 and the rear deco mounting part 244 and then be fixed to be mounted on the cooktop part 20. Also, one side of the cover part 281 of the deco member 28 may cover the side end of the burner plate 510. Also, the other side of the cover part 281 may support the side end of the sous vide module 40 or the induction module 60 at the lower side. Thus, in the state in which the deco member 28 is mounted, the space between the cooking modules may be not exposed.

As illustrated in FIG. 20, a side groove may be stepped on the lower end of the side surface of the sous vide frame 440, and the cover part 281 may be inserted into the side groove 441. Since the end of the cover part 281 is inserted into the side groove 441, the cover part may cover the gap so that the gap is not exposed to the outside of the sous vide frame 440 and also be coupled so that the sous vide frame 440 is stably mounted without moving.

The deco member 28 may support the side end of the cooking module 30 such as the sous vide module 40 and the induction module 60, which are disposed on both sides. Thus, the deco member 28 may be called a supporting member.

Figure 21:
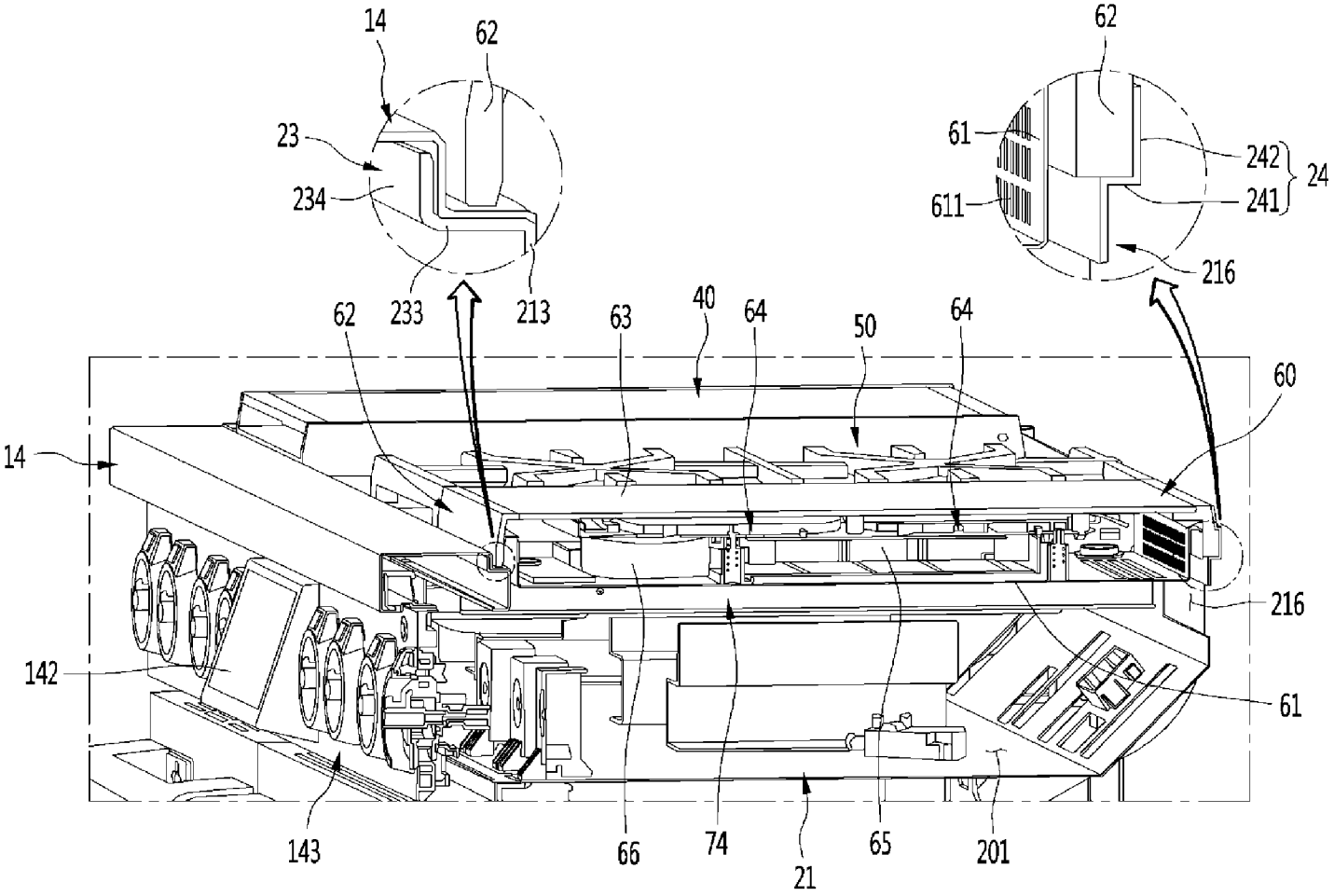
FIG. 21 is a cutaway perspective view taken along line 21-21' of FIG. 1.
Figure 22:
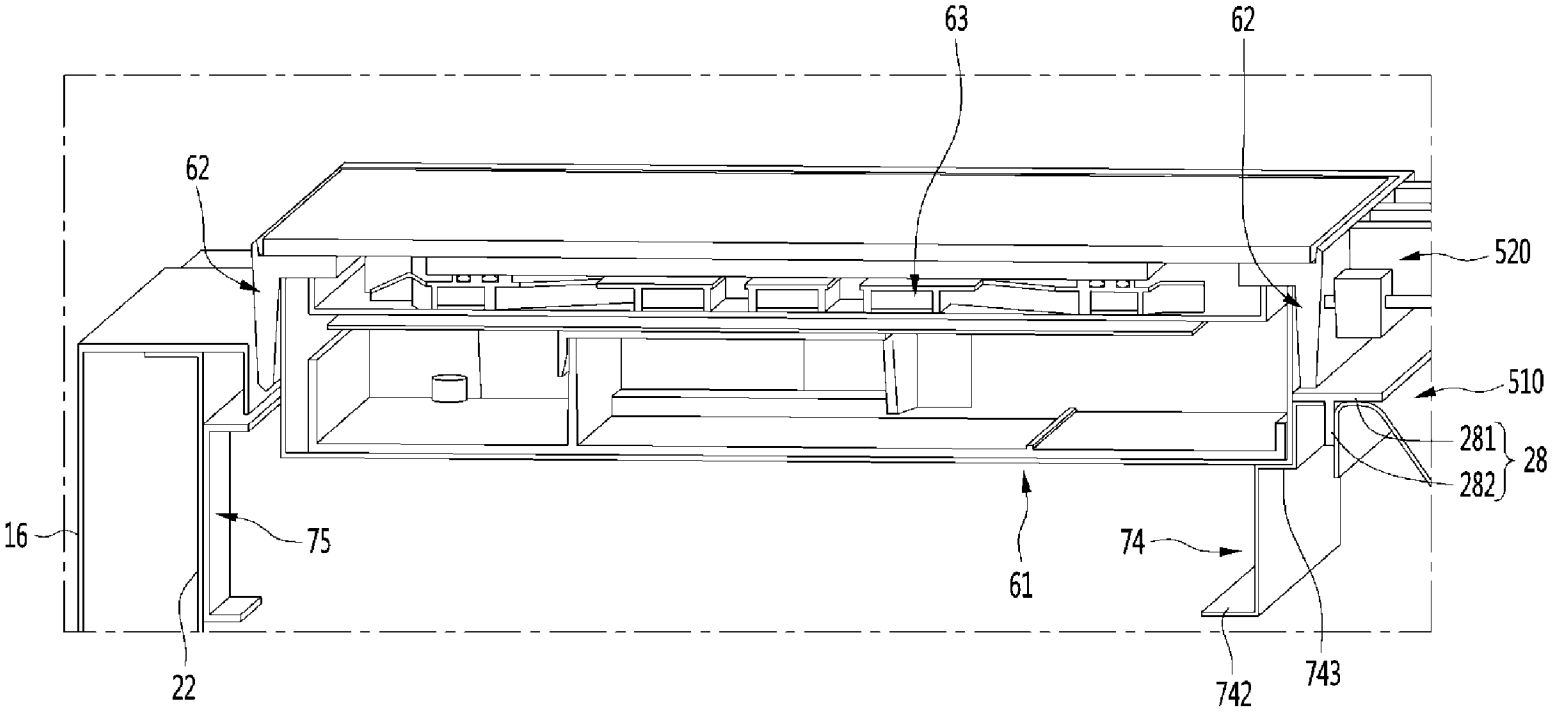
FIG. 22 is a cutaway perspective view taken along line 22-22' of FIG. 1.

FIG. 21 is a cutaway perspective view taken along line 21-21' of FIG. 1. Also, FIG. 22 is a cutaway perspective view taken along line 22-22' of FIG. 1.

As illustrated in the drawings, the induction module may be disposed at the rightmost side of the cooktop part 20. The induction module 60 may be disposed in parallel to the burner module 50.

The induction module 60 may include an induction case 61 accommodating the deice for the induction heating such as a working coil 64, an induction frame 62 mounted on a circumference of the induction case 61, and a top plate 63 covering the induction case 61 and defining the top surface of the induction module 60.

The working coil 64 may be provided on each of front and rear portions of the inside of the induction case 61. Also, the working coil 64 may be disposed adjacent to a bottom surface of the top plate 63. Also, an induction PCB 65 for an operation of the working coil 64 may be provided in the induction case 61. The induction PCB 65 may be provided below the working coil 64.

Also, an induction fan 66 may be provided in the front portion of the induction case 61. The induction fan 66 may be mounted in the induction case 61 at a front side of the induction PCB 65. Also, the induction case 61 may include a case inlet (not shown) through which the cooling air is introduced ad a case outlet 611 through which the cooling air is discharged. The case outlet 611 may be disposed at a position corresponding to the air hole 214 of the base plate 21.

Although not shown in detail, the case inlet may be provided at one side corresponding to the induction fan 66 and connected to the cold air inflow hole 222 through a cooling duct to introduce the cooling air into the induction case 61 so that the inside of the induction case 61 is cooled.

Both sides of the induction module 60 may be fixed by the first bracket 74 and the second bracket 75. Particularly, the first bracket 74 may be seated on an edge of the induction case 61 on the upper seating part 743, and the lower end of the induction frame 62 may be supported by the flange 744. Also, the bracket support 752 of the second bracket 75 may support the other side surface of the induction case 61.

The deco member 28 may be mounted between the flange 744 of the first bracket 74 and the burner plate 510. The front and rear ends of the deco member 28 may be respectively fixed by the front support 23 and the rear support 24 to partition the inner space of the cooktop part 20. Also, the gap between the burner module 50 and the induction module 60 may be covered by the deco member 28.

Also, front and rear ends of the induction module 60 may be supported by the front seating part 233 of the front support 23 and the rear seating part 241 of the rear support 24, respectively. Also, as necessary, the front end of the induction module 60 may be fixed by the front support 23 and the rear support 24.

Also, both the side ends of the induction module 60 may be supported by the induction bracket 73, i.e., the first bracket 74 and the second bracket 75 so that the induction module 60 is more stably mounted.

The induction module 60 may be spaced apart from the base plate 21 by the induction bracket 73, the front support 23, and the rear support 24. Also, the control PCB 29 may be mounted in a space between the induction module 60 and the base plate 21.

The panel bent part 141*a* that is bent in a shape corresponding to the front seating part 233 may be disposed on the rear end of the manipulation panel 141 constituting the manipulation part 14. The panel bent part 141*a* may overlap the front seating part 233. Here, the induction module 60 may be seated on the panel bent part 141*a* of the rear end of the manipulation panel 141.

When the induction bracket 73 moves to be mounted on the other unit area S, the induction module 60 may also move together to be installed.

Also, although not shown in detail, the deco member 28 may be provided between the burner module 50 and the induction module 60, and the one side end of the induction module 60 may be further supported by the deco member 28.

Figure 23:
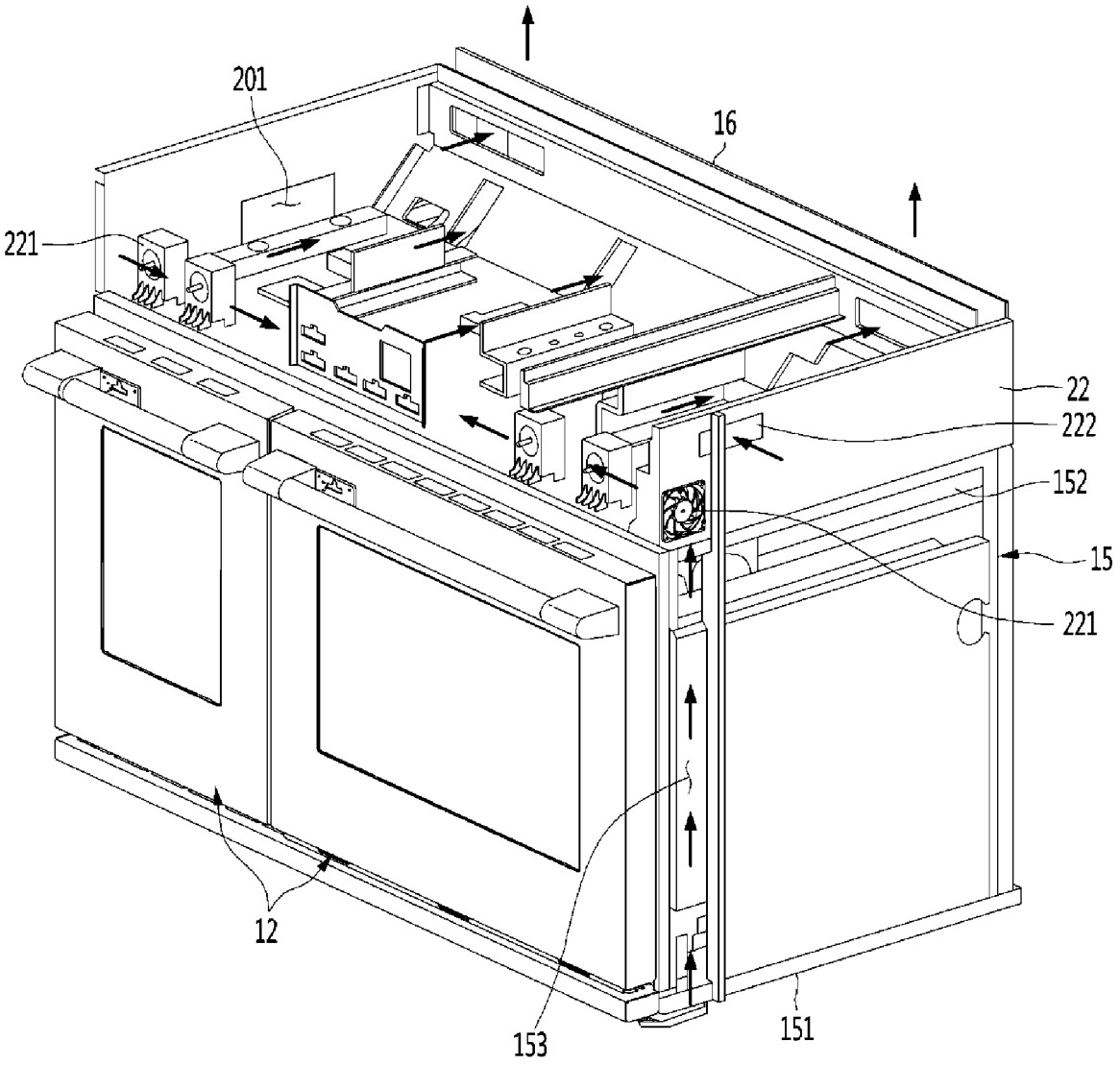
FIG. 23 is a perspective view illustrating a flow of cooling air in the cooking apparatus.
Figure 24:
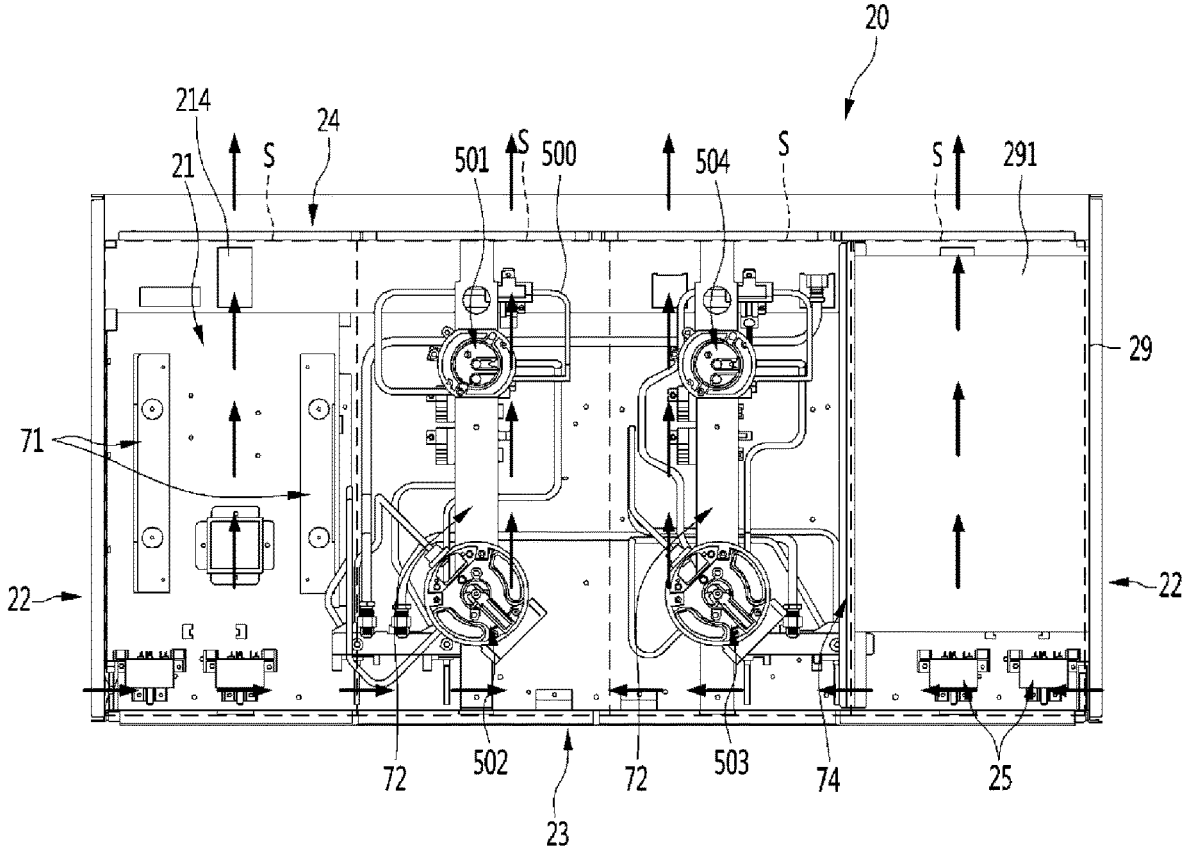
FIG. 24 is a perspective view illustrating a flow of cooling air in the cooktop part.

FIG. 23 is a perspective view illustrating a flow of the cooling air in the cooking apparatus. Also, FIG. 24 is a perspective view illustrating a flow of the cooling air in the cooktop part.

As illustrated in the drawings, when the cooktop part 20 operates, the cooling fan 221 disposed on the side plate 22 may operate to cool the cooktop part 20. The cooling fans 221 may be disposed to face each other so that the external air is introduced into the cooktop part 20 through the suction passage 153 defined in the outer plate 16.

The cooling fan 221 may be disposed on the front end of the cooktop part 20. Thus, air blown by the cooling fan 221 may cool the valve unit 26 and the knob unit 25, which are disposed on the front portion of the cooktop part 20, first. The cooling air blown from the cooling fan 221 may flow to the inside of the cooktop part 20.

The cooling air introduced into the cooktop part 20 may flow form the front portion to the rear portion of the cooktop part 20. While the cooling air flows to the rear portion of the cooktop part 20, the cooking modules 30 mounted on the cooktop part 20 may be cooled.

Also, the air flowing backward within the cooktop part 20 may be introduced into the air holes 214 of the inclined surface 212 and the rear surface 213, which define the rear surface of the module mounting space 201, and the exhaust part 13 through the air holes 216.

An exhaust fan 17 may be provided in a rear space 132 of the oven part 10 and the cooktop part 20, which communicates with the inside of the exhaust part 13 or the exhaust part 13 to discharge a combustion gas and the cooling air of the oven part 10 through the exhaust part 13. A flow of air occurs in the exhaust part 13 by the operation of the exhaust fan 17. Here, the inside of the cooktop part 20 communicating with the exhaust part 13 may decrease in pressure to allow the air within the cooktop part 20 to more smoothly flow to the exhaust part 13.

Also, the exhaust duct 133 connected to the oven part 10 may be accommodated in a rear space 132 of the oven part 10 and the cooktop part 20. Thus, the combustion gas and the heat discharged from the exhaust duct 133 may also be mixed in the space and then discharged through the exhaust part 13.

Also, the inside of the cooktop part 20 may be partitioned into the unit areas S by the insulation plate 76. Thus, the unit areas S may be uniformly cooled.

When the induction module 60 operates, the induction fan 66 may operate to allow the external air to be introduced into the induction case 61 through the side hole of the side plate 22 and cool the inside of the induction case 61 and then be discharged to the exhaust part 13.

In this structure, the control PCB 29 disposed below the induction module 60 may be cooled, and also, the induction PCB 65 within the induction module 60 may be independently cooled.

In addition to the foregoing embodiment, a cooking apparatus according to various embodiments may be exemplified.

According to another embodiment, this embodiment may be the same as the foregoing embodiment except for the number of oven parts and the number of cooking modules. Thus, the same reference numerals are used for the same components, and detailed description or illustration thereof may be omitted.

Figure 25:
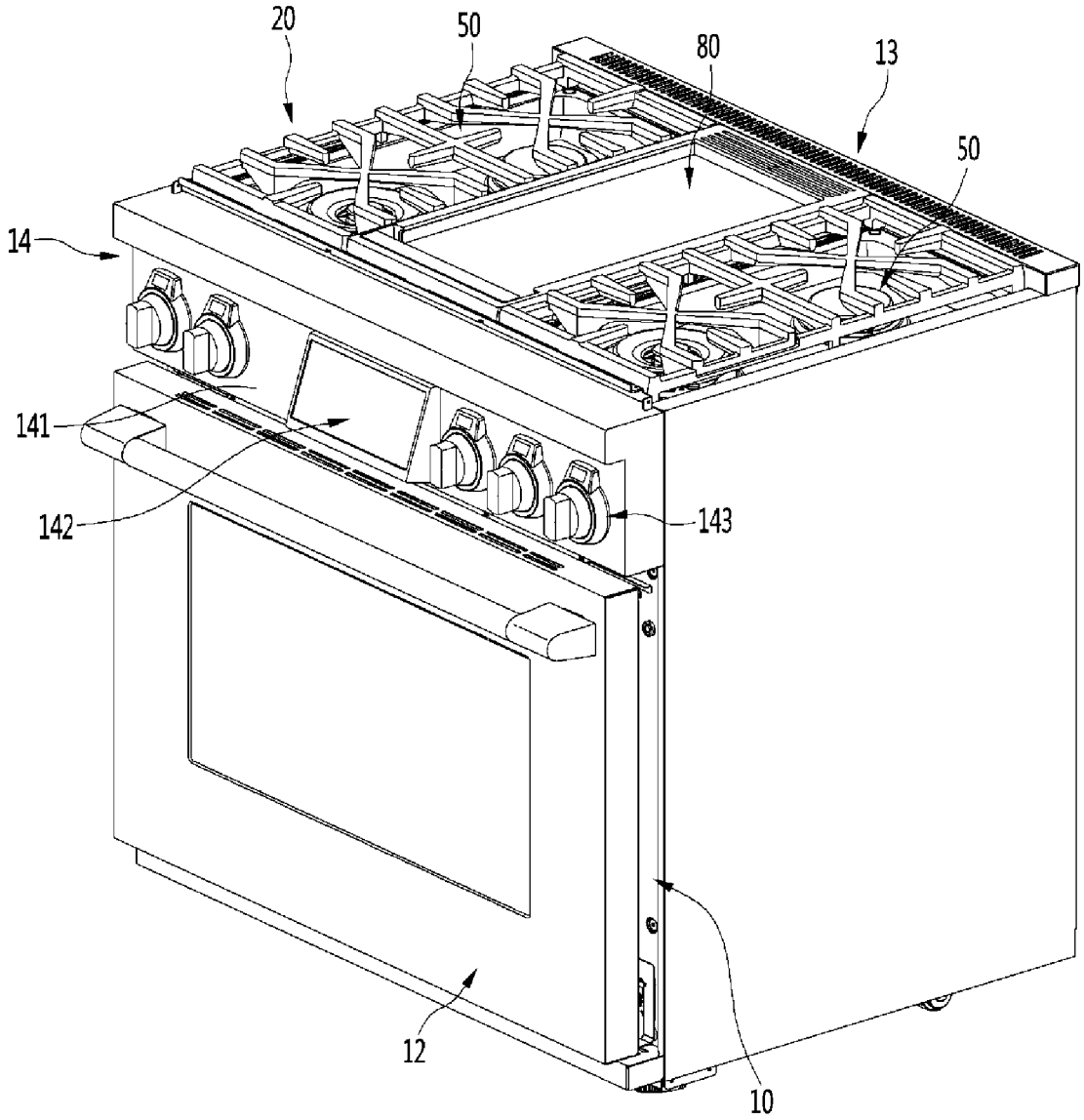
FIG. 25 is a perspective view of a cooking apparatus according to another embodiment.
Figure 26:
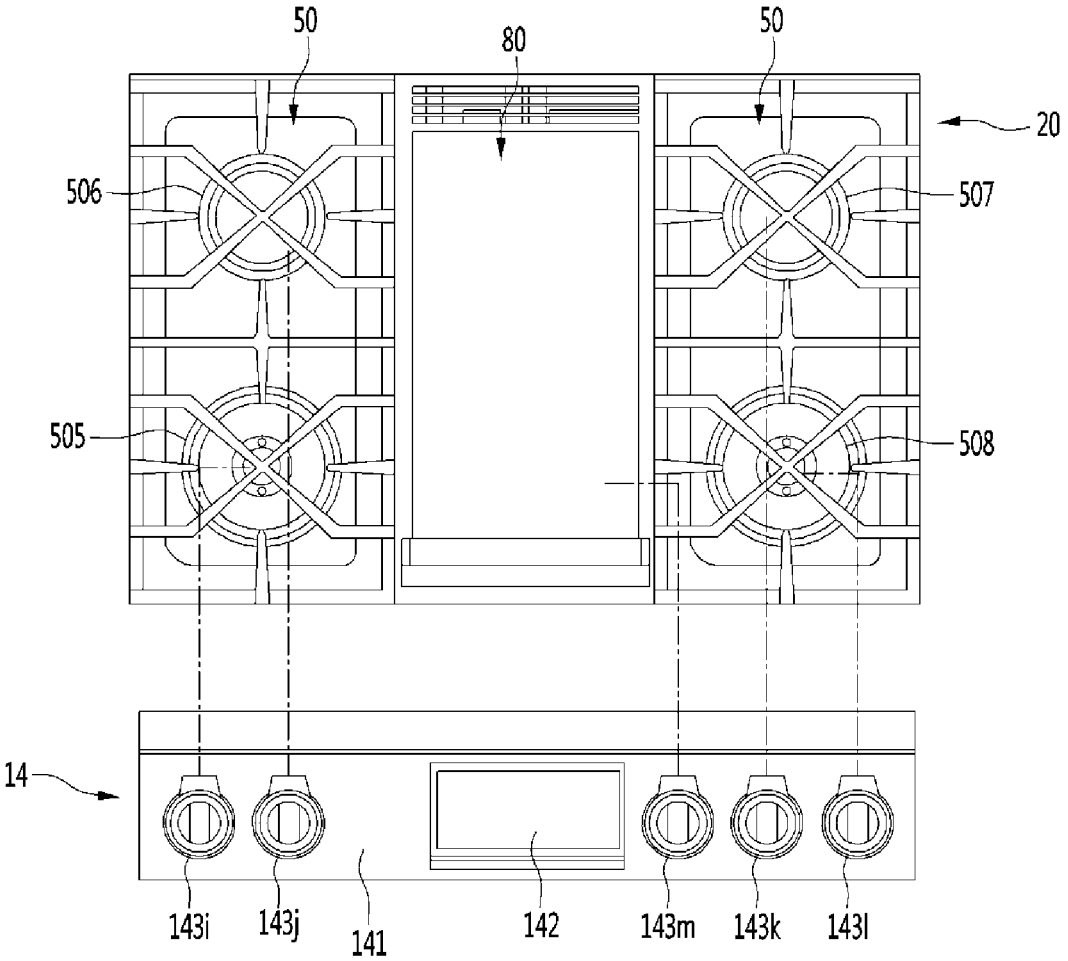
FIG. 26 is a view illustrating a relationship between a cooktop part and a manipulation part of the cooking apparatus.

FIG. 25 is a perspective view of a cooking apparatus according to another embodiment. Also, FIG. 26 is a view illustrating a relationship between a cooktop part and a manipulation part of the cooking apparatus.

A cooking apparatus 1 according to another embodiment includes one oven part 10. An outer appearance of a front surface of the cooking apparatus 1 may be defined by a door 12 for opening and closing the oven part 10, and a manipulation part 14 and a cooktop part 20 may be disposed on the oven part 10.

The manipulation part 14 may include a manipulation panel 141. A display 142 and a manipulation member 143 may be provided on the manipulation panel 141.

The cooktop part 20 may be divided into three unit areas, and three cooking modules 30 may be respectively disposed on the three unit areas. An exhaust part 13 may be provided on a rear end of the cooktop part 20.

The cooking modules 30 may include a griddle module 80 disposed at a center and a burner module 50 disposed on each of both left and right sides of the griddle module 80. In the burner module 50, the burner modules 50 having the same structure may be respectively disposed on both sides of the griddle module 80.

In each of the burner modules 50, a pair of burners 505 and 506/507 and 508 may be disposed on front and rear sides. For example, a fifth burner 505 and a sixth burner 506 may be provided in the left burner module 50, and a seventh burner 507 and an eighth burner 508 may be provided in the right burner module 50.

Also, the manipulation member 143 may be provided on a front surface of the manipulation part 14 and provided in number corresponding to the number of burner modules 50. That is, a ninth manipulation member 143*i* and a tenth manipulation member 143*j* may be provided at a front side of the left burner module 50 to manipulate the fifth burner 505 and the sixth burner 506, and an eleventh manipulation member 143*k* and a twelfth manipulation member 143*l* may be provided at a front side of the right burner module 50 to manipulate the seventh burner 507 and the eighth burner 508.

Also, a thirteenth manipulation member 143*m* for manipulating a temperature of the griddle module 80 may be provided at a side of the display 142.

The cooking module 30 mounted on the cooktop part 20 may be mounted on the cooktop part 20 through the mounting structure according to the foregoing embodiment.

Figure 27:
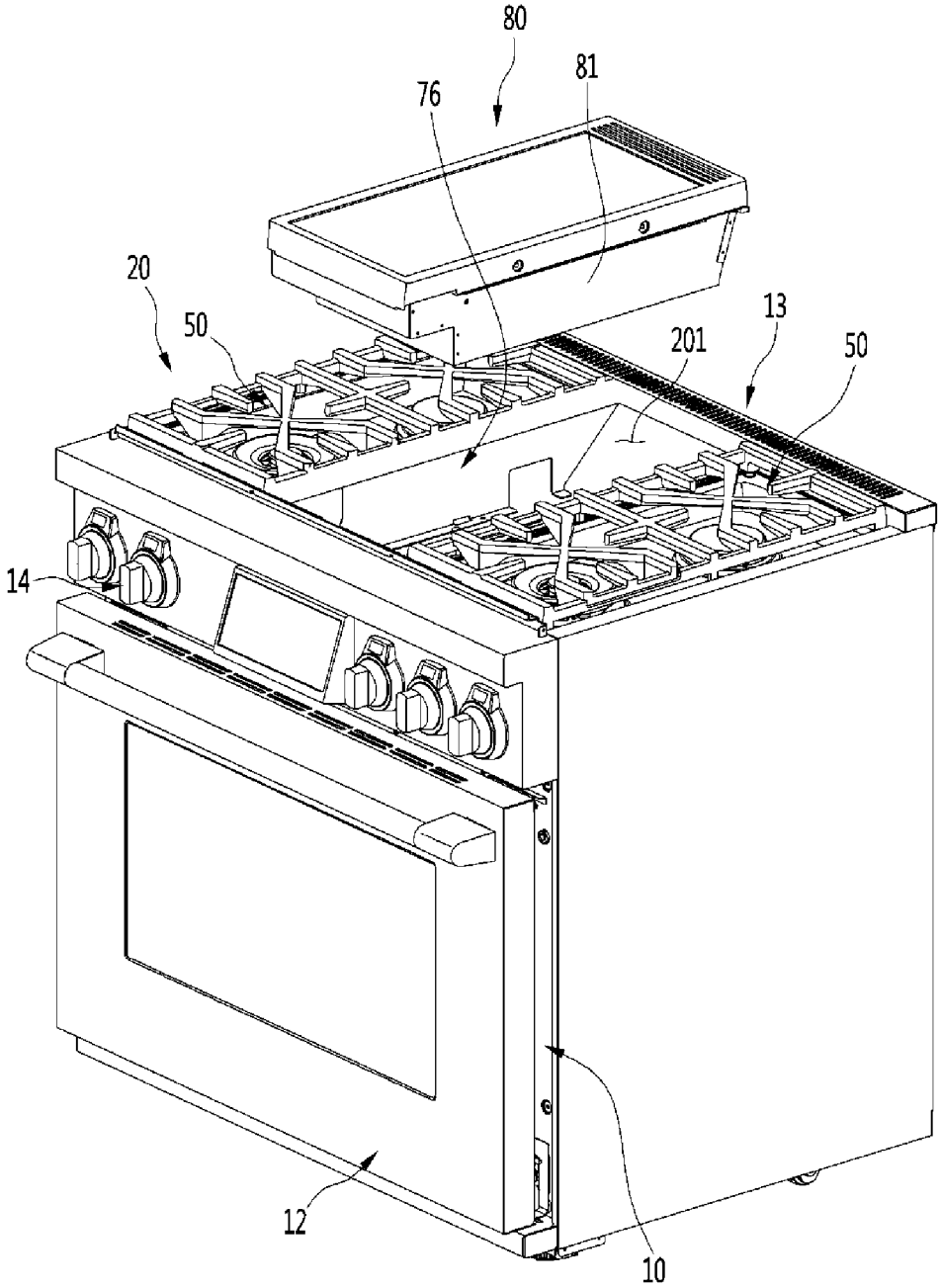
FIG. 27 is an exploded perspective view illustrating a state in which a griddle module of a cooking module is separated from the cooktop part.
Figure 28:
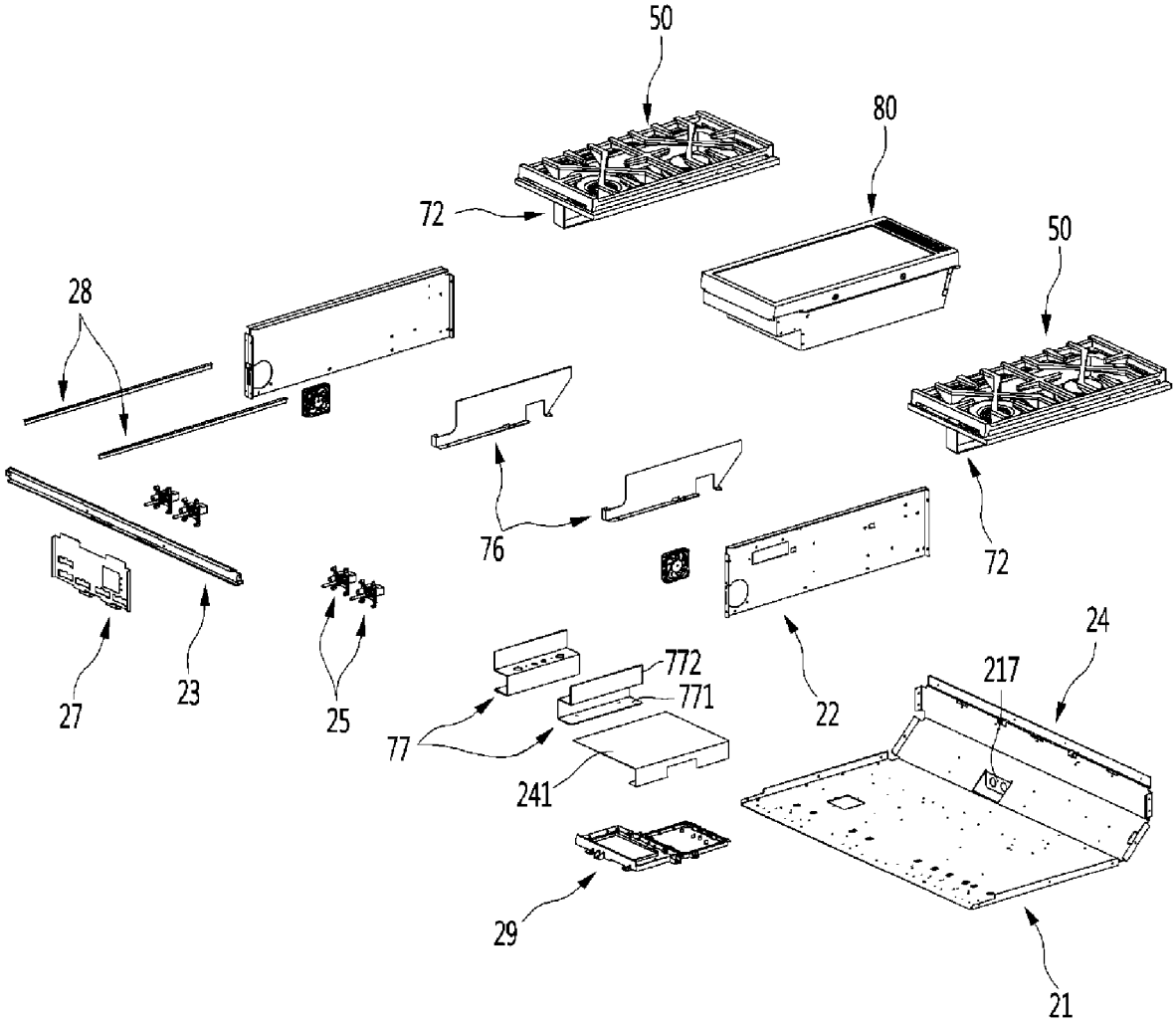
FIG. 28 is an exploded perspective of the cooktop part.

FIG. 27 is an exploded perspective view illustrating a state in which the griddle module of the cooking module is separated from the cooktop part. Also, FIG. 28 is an exploded perspective of the cooktop part.

As illustrated in the drawings, the cooktop part 20 may provide a module mounting space 201 by a base plate 21 and a side plate 22. The manipulation part 14 may be provided on an opened front surface of the cooktop part 20 to cover the opened front surface of the cooktop part 20.

A front support 23 may be provided on a front end of the cooktop part 20. Both ends of the front support 23 may be fixed to the deco member, and a front end of the cooking module 30 may be seated. Also, a rear support 24 may be provided on an upper end of a rear surface of the base plate 21.

Although not shown in detail, a front bracket mounting part 236 and a rear bracket mounting part 243 for mounting the burner bracket 72 may be respectively provided on the front support 23 and the rear support 24, and also, a front deco mounting part and a rear deco mounting part 244 for mounting the deco member 28 may be respectively provided on the front support 23 and the rear support 24.

As described above, the cooking modules 30 may have the same mounting structure as the cooking modules according to the foregoing embodiment except for the number of cooking modules 30.

Also, a control PCB 29 may be provided in the cooktop part 20. The control PCB 29 may be shielded by a shield member 291. An insulation plate 76 may be provided in the cooktop part 20.

The base plate 21 may include a bottom surface 211, an inclined surface 212, and a rear surface 213 like the forgoing embodiment. However, according to this embodiment, a base opening 217 may be defined in the inclined surface 212 of the base plate 21. According to another embodiment, if the number of unit areas S is small, a separate different air hole 214, an upper air hole 216, and a tube hole 215 may not be defined for each unit area S, but only one base opening 217 through which a gas tube is accessible may be provided in the inclined surface 212. A wire and the gas tube 500 may be accessible through the base opening 217, and also, air within the cooktop part 20 may be discharged through the base opening 217.

A griddle bracket 77 may be provided in the cooktop part 20. The griddle bracket 77 may be mounted on a bottom surface 211 of the base plate 21 to support a bottom surface of the griddle module 80.

The griddle bracket 77 may be provided in a pair and include a griddle support 771 fixed to the base plate 21 and a griddle extension part 772 extending upward from an end of the griddle support 771.

A bottom surface of the griddle support 771 may be fixed to be mounted on the base plate 21. Also, a top surface of the griddle support 771 may support a bottom surface of the griddle module 80. Also, the griddle module 80 may be fixed to the griddle support 771 by a screw coupled to the inside of the griddle module 80.

Also, the griddle extension part 772 may extend upward to support both left and right side surfaces of the griddle module 80. Thus, the griddle module 80 may be stably mounted on the cooktop part 20.

Figure 29:
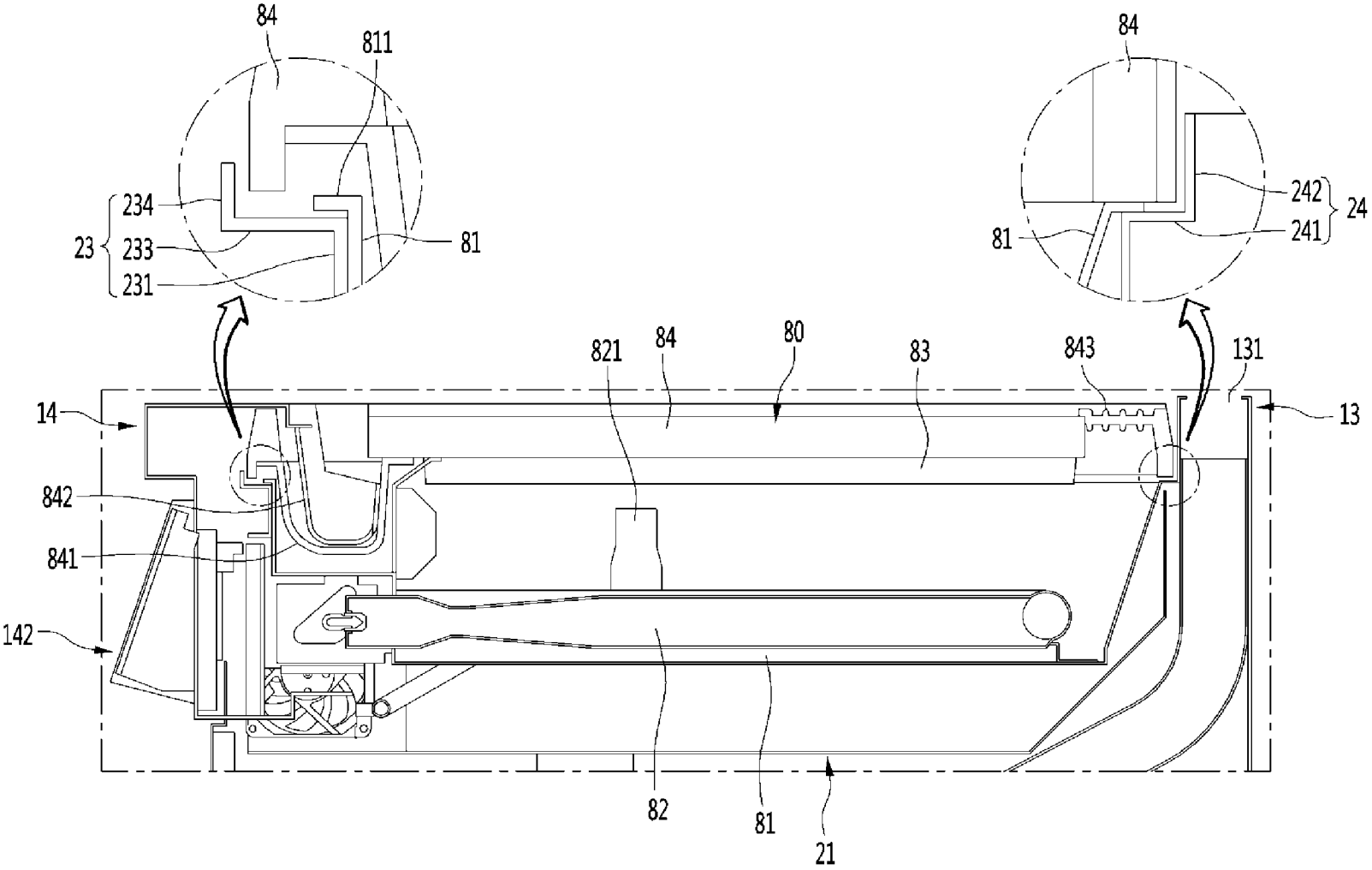
FIG. 29 is a cross-sectional view taken along line 29-29' of FIG. 25.

FIG. 29 is a cross-sectional view taken along line 29-29' of FIG. 25.

As illustrated in the drawing, the griddle module 80 may be provided at a center of the cooktop part 20. That is, the griddle module 80 may be mounted on the unit area S disposed at the center of the cooktop part 20.

The griddle module 80 may include a griddle case 81 in which a griddle burner 82 for heating is accommodated, a griddle plate 83 covering an opened top surface of the griddle case 81, and a griddle frame 84 defining a circumference of the griddle plate 83.

A top surface of the griddle case 81 may have an opened box shape, and a bottom surface of the griddle case 81 may be coupled to the griddle bracket 77. Also, a case flange 811 bent outward may be provided on a circumference of the griddle case 81 and seated on the front support 23 and the rear support 24.

The griddle burner 82 may burn a supplied gas to heat the griddle plate 83 and be inserted from the outside of the griddle case 81 to the inside of the griddle case 81.

Also, a temperature detection device 821 may be provided on the griddle case 81 to detect a temperature of the griddle plate 83 by using the temperature detection device 821, thereby adjusting thermal force of the griddle burner 82.

The griddle plate 83 may cover the most area of the opened top surface of the griddle case 81, and a remaining circumferential portion may be covered by the griddle frame 84. The griddle plate 83 may be heated by the griddle burner 82 to heat and cook food on the griddle plate 83.

The griddle frame 84 may define a circumference of an upper portion of the griddle module 80 and be coupled to the upper end of the griddle case 81. The griddle frame 84 may be made of the same cast iron material as the grating 520.

The griddle frame 84 may further protrude outward from a circumferential surface of the griddle case 81. Thus, when the griddle module 80 is mounted, the griddle frame 84 may be seated on the front support 23 and the rear support 24 to support the griddle module 80. Also, when the deco member 28 is provided, both left and right ends of the griddle frame 84 may be supported by the pair of deco members 28.

A pocket part 841 may be provided between the front end of the griddle plate 83 and an inner surface of the griddle frame 84. The pocket part 841 may be recessed to the inside of the griddle case 81 to accommodate foreign substances and oil, which are generated when the food is cooked on the griddle plate 83. Also, a separable oil pan 842 may be further provided in the pocket part 841 to accommodate the foreign substances and the oil in the oil pan 842.

Also, a griddle exhaust part 843 may be provided between the rear end of the griddle plate 83 and the rear end of the griddle frame 84. A combustion gas within the griddle case 81 may be discharged upward by the griddle exhaust part 843. The griddle exhaust part 843 may be disposed very adjacent to an exhaust part 13. Thus, even though a separate fan is not provided, the exhaust is performed through the exhaust part 13, the combustion gas within the griddle exhaust part may also be discharged due to a pressure difference.

Other cooking modules 30 in addition to the griddle module 80 may be mounted in the cooktop part 20. Also, a module bracket corresponding to the cooking module 30 may be provided in the cooktop part 20.

In addition to the foregoing embodiments, various embodiments may be exemplified.

According to another embodiment, an oven part is vertically disposed, and all cooking modules are provided as burner modules in a cooktop part. Since other constructions not specifically described are the same as those in the above-described embodiments, the same reference numerals are used or a detailed description thereof will be omitted.

Figure 30:
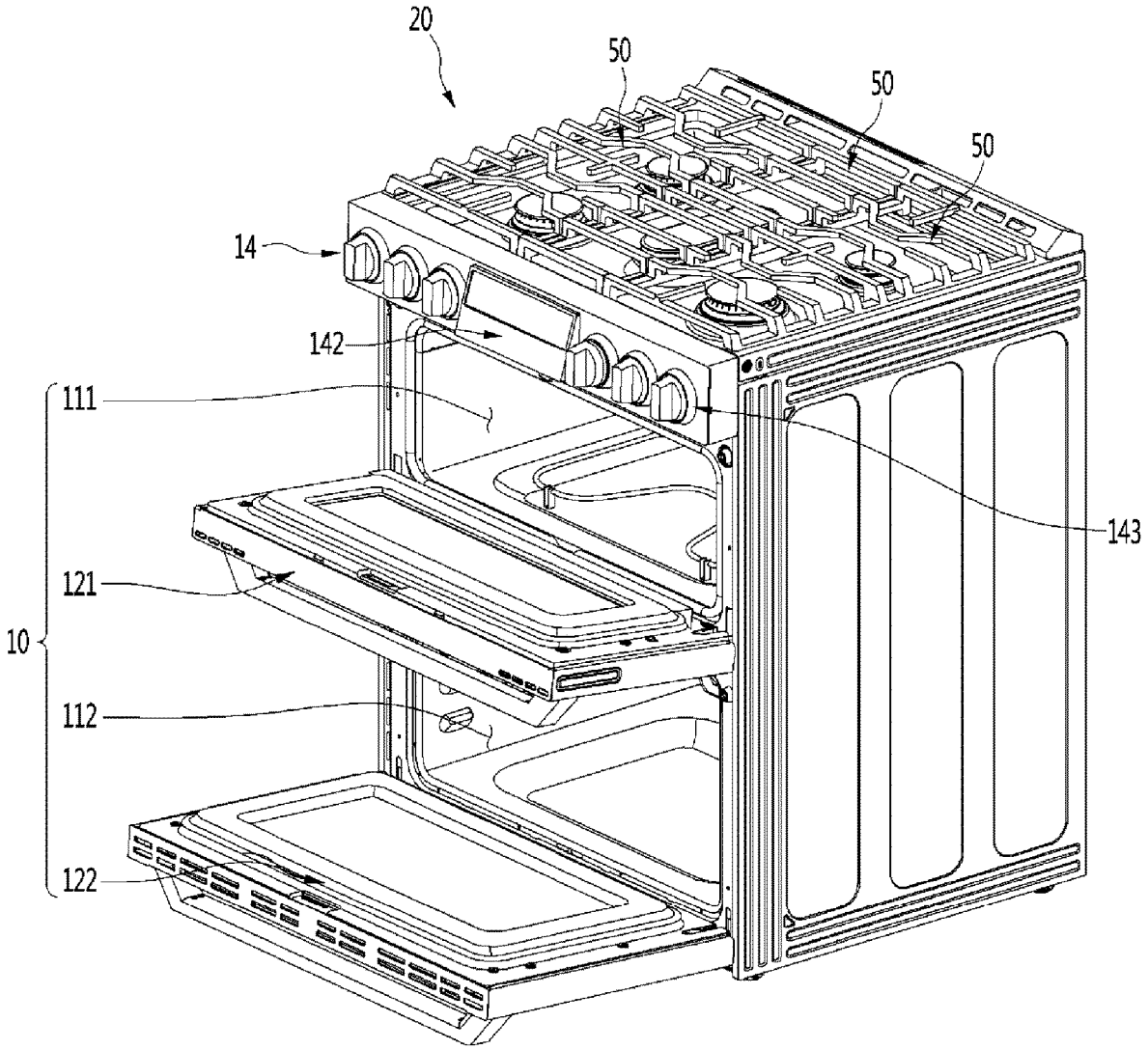
FIG. 30 is a perspective view of a cooking apparatus according to another embodiment.

FIG. 30 is a perspective view of a cooking apparatus according to another embodiment.

As illustrated in the drawing, in a cooking apparatus 1 according to another embodiment, an oven part 10 may be provided in plurality, and the plurality of oven parts 10 may be vertically disposed. That is, the oven parts 10 may be constituted by an upper cavity 111 that is opened and closed by an upper door 121 and a lower cavity 112 that is opened and closed by a lower door 122.

Also, a cooktop part 20 may be provided above the oven part 10. Also, a manipulation part 14 including a display 142 and a manipulation member 143 may be provided on a front end of the cooktop part 20, and an exhaust part 13 may be provided on a rear side of the cooktop part 20.

The cooktop part 20 may be divided into three unit areas S, and independent burner modules 50 may be respectively provided on the three unit areas S. A mounted structure of each of the burner modules 50 and a detailed structure of each of the burner module 50 may be the same as those according to the foregoing embodiment, and thus, their detailed descriptions will be omitted.

As described above, only the same cooking module may be mounted in the cooktop part. As necessary, the cooktop part 20 may be provided through combination with different cooking module 30, but not the burner module 50.

Like the foregoing embodiments, three or four unit areas S may be provided. As necessary, the unit area S may be further provided in a horizontal direction.

The same cooking modules 30 may be successively disposed in the cooktop part 20 that is divided into a plurality of unit areas S to successively occupy the plurality of unit areas S. Alternatively, one cooking module 30 may be disposed to occupy the plurality of unit areas S, which are spaced apart from each other. Also, one cooking module 30 may have a size corresponding to that of the plurality of unit areas.

Also, the cooktop part 20 provided by the combination of the plurality of cooking modules 30 may not be provided in a complex type cooking apparatus 1, but be provided in a separate case to solely constitute the cooking apparatus or may be built in the cooking apparatus 1.

The cooking apparatus according to the embodiment may expect the following effects.

In the cooking apparatus according to the embodiment, the various cooking modules may be disposed in the cooktop part to improve the use convenience.

Particularly, the cooking modules may be variously combined with each other on the cooktop part, and also, the cooking module having a necessary function may be selectively mounted.

Also, the cooking modules may be provided to have the same length in the front and rear direction and the width that is equal to the unit length or a multiple of the unit length. Thus, the cooking module may be freely disposed within the unit area provided on the cooktop part.

Particularly, the front support and the rear support may be provided on the cooktop part to support all the front and rear ends of the cooking module irrespective of various cooking modules so that the cooking module is mounted.

The module bracket corresponding to the cooking module may be provided on the cooktop part to effectively support each of the cooking modules.

The manipulation member may be disposed at the front side corresponding to the cooking module according to the arrangement of the cooking module. The cooktop part may have the opened front surface. Thus, the valve unit and the knob unit connected to the manipulation member may be freely disposed to allow the manipulation member to be disposed at the front side corresponding to the cooking module, thereby more improving the use convenience.

Also, the deco member may be provided between the cooking modules and supported by the front support and the rear support. The gap between the cooking modules adjacent to each other may be covered by the deco member to more improve the outer appearance of the cooking apparatus.

Also, the deco member may support the side end of the cooking module, and thus, the cooking module mounted on the cooktop part may be more stably mounted.

Also, the cooling fan may be provided on the cooktop part and have communicating with the exhaust part to effectively cooling part and the cooking module.

Also, the insulation plate that partitions the unit areas may be provided in the cooktop part to prevent the heat from being transferred to the adjacent cooking module. Furthermore, the cooling air flowing through the inside of the cooktop part may uniformly flow through the entire cooktop part.

Also, the cooking modules may have the same height in the state of being mounted on the cooktop part to provide the sense of unit and also more improve the outer appearance.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking apparatus, comprising:

an oven on which a door that opens and closes a cavity defining a cooking space is provided on a front surface thereof; and a cooktop provided above the oven to define a top surface of the cooking apparatus, wherein the cooktop comprises:

a module mounting space provided in the cooktop and having an open top surface;

a plurality of cooking modules mounted through the open top surface of the module mounting space;

a base plate defining a bottom surface of the module mounting space;

a front support provided along a front end of the module mounting space and disposed at a position that is spaced upward apart from a front end of the base plate to support all front ends of the plurality of cooking modules;

a rear support provided along a rear end of the module mounting space to support all rear ends of the plurality of cooking modules;

a manipulation panel defining an outer appearance of the cooktop and that covers a front opening between the front support and base plate; and a manipulation member mounted on the manipulation panel and connected to a knob unit or a valve unit through the front opening, wherein the plurality of cooking modules has a same unit length or lengths that corresponds to a multiple of the unit length in a horizontal direction to respectively cover unit areas of the module mounting space, wherein the plurality of cooking modules and the manipulation member are selectively arranged at one of the unit areas of the module mounting space, wherein the manipulation member is disposed at a front side of a unit area of each of the plurality of cooking modules to manipulate an operation of a corresponding cooking module of the plurality of cooking modules, wherein the knob unit or the valve unit is disposed on the base plate, wherein a knob unit coupling hole or a valve unit coupling hole in which the knob unit or the valve unit is mounted is defined in the base plate, and wherein the knob unit coupling hole or the valve unit coupling hole is defined in each of all of the unit areas.

2. The cooking apparatus according to claim 1, wherein the knob unit or the valve unit is disposed in a space between the front support and the base plate and selectively mounted at a same position according to an arrangement of the plurality of cooking modules.

3. The cooking apparatus according to claim 1, wherein the cooktop comprises:

a side plate provided on each of both sides of the base plate to define each of both side surfaces of the module mounting space.

4. The cooking apparatus according to claim 3, wherein a side cooling fan is provided on each side plate and configured to suction external air to cool the valve unit or the knob unit, and wherein the side fans are disposed on a front end of the cooktop and disposed to face each other so that the external air is introduced into the cooktop.

5. The cooking apparatus according to claim 3, wherein both ends of the front support are connected to the side plates to define the front opening.

6. The cooking apparatus according to claim 3, wherein the base plate comprises:

a bottom surface defining the bottom surface of the module mounting space; and a rear surface bent from a rear surface of the bottom surface of the base plate to define a rear surface of the module mounting space, and wherein the rear support is disposed on an upper end of the rear surface of the base plate.

7. The cooking apparatus according to claim 6, wherein the rear support is provided by bending an upper end of the rear surface of the base plate.

8. The cooking apparatus according to claim 6, further comprising:

an exhaust provided at a rear side of the cooktop to discharge heat of the oven and the cooktop; and an opening that communicates with the exhaust to exhaust air for cooling an inside of the cooktop defined in each unit area of the base plate.

9. The cooking apparatus according to claim 8, wherein an opening that communicates with an inner space of the exhaust and through which air within the plurality of cooking modules is exhausted through the exhaust is defined in the rear surface of the base plate facing the rear surface of each of the plurality of cooking modules.

10. The cooking apparatus according to claim 9, wherein the opening is defined in each of all of the unit areas.

11. The cooking apparatus according to claim 6, wherein an opening through which a gas tube connected to the plurality of cooking modules is accessible is defined in each unit area of the base plate.

12. The cooking apparatus according to claim 1, further comprising:

a module bracket provided inside of the module mounting space to additionally support the plurality of cooking modules, wherein the module bracket supports lower surfaces of the plurality of cooking modules so that the lower surfaces of the plurality of cooking modules are spaced apart from a base of the module mounting space.

13. The cooking apparatus according to claim 12, wherein a front bracket mounting portion and a rear bracket mounting portion to which a front end and a rear end of the module bracket are detachably coupled are provided on the front support and the rear support, respectively, and wherein the front bracket mounting portion and the rear bracket mounting portion are disposed in each unit area.

14. The cooking apparatus according to claim 12, wherein the plurality of cooking modules comprises a plurality of combinations of:

a burner module comprising at least one or more burners;

an induction module that heats a container in an induction heating manner using a working coil;

a sous vide module that heats the container within a housing that is sealed by a sous vide door through a heating part heater; and a griddle module that heats a griddle plate, which is exposed upward, by a griddle burner provided in a griddle case.

15. The cooking apparatus according to claim 14, wherein the module bracket comprises:

a burner bracket that supports a lower portion of each of the plurality of burners and both ends of which are coupled to the front support and the rear support;

a pair of induction brackets that both side ends of the induction module;

a sous vide bracket mounted on a bottom of the module mounting space to support a lower portion of the housing; and a griddle bracket mounted on the bottom of the module mounting space to support a lower portion of the griddle case.

16. The cooking apparatus according to claim 1, wherein a deco member that extends from the front support to the rear support to cover a space between the plurality of cooking modules is provided between the plurality of cooking modules disposed adjacent to each other.

17. The cooking apparatus according to claim 16, wherein a front deco mounting portion and a rear deco mounting portion to which a front end and a rear end of the deco member are detachably coupled are provided on the front support and the rear support, respectively, and wherein the front deco mounting portion and the rear deco mounting portion are disposed in each unit area.

18. The cooking apparatus according to claim 1, wherein an insulation plate that partitions the unit areas to prevent heat from being transferred to adjacent areas is provided in the module mounting space.

* * * * *